US006854247B2

(12) United States Patent
Lancaster, III et al.

(10) Patent No.: US 6,854,247 B2
(45) Date of Patent: Feb. 15, 2005

(54) METHOD AND APPARATUS FOR STRETCH WRAPPING A LOAD

(75) Inventors: Patrick R. Lancaster, III, Louisville, KY (US); David Eldridge, Ferncreek, KY (US); Christopher Sandfort, Louisville, KY (US)

(73) Assignee: Lantech.com, LLC, Louisville, KY (US)

( * ) Notice: Subject to any disclaimer, the term of this patent is extended or adjusted under 35 U.S.C. 154(b) by 0 days.

(21) Appl. No.: 10/322,476

(22) Filed: Dec. 19, 2002

(65) Prior Publication Data

US 2003/0084646 A1 May 8, 2003

Related U.S. Application Data

(62) Division of application No. 09/910,858, filed on Jul. 24, 2001, now Pat. No. 6,516,591, which is a continuation of application No. 09/026,527, filed on Feb. 20, 1998, now Pat. No. 6,293,074.

(51) Int. Cl.[7] ..... B65B 11/04

(52) U.S. Cl. ..... 53/556; 53/587; 53/588; 53/210

(58) Field of Search ..... 53/587, 588, 589, 53/556, 210, 211

(56) References Cited

U.S. PATENT DOCUMENTS

| | | | | |
|---|---|---|---|---|
| 4,152,879 A | * | 5/1979 | Shulman | 53/587 |
| 4,216,640 A | | 8/1980 | Kaufman | |
| 4,300,326 A | | 11/1981 | Stackhouse | |
| 4,432,185 A | | 2/1984 | Geisinger | |
| 4,563,863 A | * | 1/1986 | Humphrey | 53/556 |
| 4,735,033 A | | 4/1988 | Stackhouse | |
| 4,858,415 A | | 8/1989 | Hake | |
| 4,993,209 A | | 2/1991 | Haloila | |
| 5,020,300 A | | 6/1991 | Casteel | |
| 5,138,818 A | * | 8/1992 | Humphrey | 53/556 |
| 5,450,711 A | | 9/1995 | Martin-Cocher | |
| 5,452,566 A | | 9/1995 | Benhamou et al. | |
| 5,463,842 A | | 11/1995 | Lancaster | |
| 5,564,258 A | | 10/1996 | Jones, Sr. et al. | |
| 5,606,849 A | | 3/1997 | Bettenhausen | |
| 5,740,662 A | | 4/1998 | Royneberg et al. | |
| 5,749,206 A | | 5/1998 | Moore et al. | |
| 5,758,471 A | | 6/1998 | Denley et al. | |
| 5,768,862 A | | 6/1998 | Mauro | |
| 5,802,810 A | | 9/1998 | Wojcik et al. | |
| 5,819,503 A | | 10/1998 | Lancaster, III | |
| 5,878,555 A | | 3/1999 | Turfan et al. | |

FOREIGN PATENT DOCUMENTS

| | | | | |
|---|---|---|---|---|
| DE | 3820048 | | 12/1989 | |
| EP | 0386397 A1 | * | 9/1990 | B65B/11/02 |
| EP | 0 630 813 | | 6/1994 | |
| FR | 2493802 | | 11/1980 | |
| GB | 2014107 A | | 8/1979 | |
| GB | 2216489 A | | 10/1989 | |
| GB | 0 430 902 | | 6/1991 | |
| NL | 27 17 647 | | 11/1978 | |

* cited by examiner

*Primary Examiner*—Stephen F. Gerrity
(74) *Attorney, Agent, or Firm*—Finnegan, Henderson, Farabow, Garrett & Dunner, LLP

(57) ABSTRACT

A leading end of packaging material is attached to a retainer to hold the leading end of the packaging material as the retainer moves toward the load. The retainer is positioned adjacent the load and packaging material is dispensed from a packaging material dispenser, and relative rotation is provided between the dispenser and a load to wrap packaging material around the load. The packaging material is released from the retainer in response to force applied to the retainer to withdraw it from the wrapped load.

2 Claims, 22 Drawing Sheets

METHOD AND APPARATUS FOR STRETCH WRAPPING A LOAD

CROSS REFERENCE TO RELATED APPLICATIONS

This is a division of U.S. application Ser. No. 09/910,858, filed Jul. 24, 2001, now U.S. Pat. No. 6,516,591, which is a continuation of U.S. application Ser. No. 09/026,527, filed Feb. 20, 1998, now U.S. Pat. No. 6,293,074, both of which are incorporated herein by reference.

BACKGROUND OF THE INVENTION

The present invention relates to a method and apparatus for wrapping a load with packaging material.

Loads have been stretch wrapped with stretch wrap packaging material by dispensing the packaging material, securing a leading end of the packaging material to the load or a turntable clamp, and providing relative rotation between the load and a packaging material dispenser to cause the load to be enveloped by the packaging material. The relative rotation can be provided several different ways. Either the load can be rotated on a turntable, or the dispenser can be rotated around the stationary load. Stretch wrapping usually employs a web of stretch film as the packaging material.

Semi-automatic stretch wrapping machinery requires the operator to attach a leading end of the packaging material to the load. This is typically accomplished by forming a rope in the leading end of the film and then inserting this end between the layers of the load or tying the end of the packaging material to the edge of the supporting wood pallet or any suitable outcropping on the load. This attachment must be relatively strong since it provides the resistance to pulling the film from the film dispenser during the initiation of the relative rotation between the load and the film dispenser. The attachment or tying of the film makes film removal more difficult after the load has been shipped to its destination.

Automatic stretch wrapping machines typically use film clamps that grip the film web between two opposed surfaces and use electrical or pneumatic actuators to open and close the clamps. Such film clamps create a "tenting" effect during wrapping due to the distance between the clamp and the load during wrapping, resulting in wasted film and loosely wrapped loads. Such clamps are expensive and may require costly maintenance for the electrical and mechanical actuators.

In light of these drawbacks, there is a need for a method and apparatus for wrapping a load with packaging material that operates as effectively as those previously developed but which can be manufactured at a lower cost.

SUMMARY OF THE INVENTION

Accordingly, the present invention is directed to a method and apparatus for wrapping a load with packaging material which provides advantages and obviates a number of problems in earlier methods and apparatus for wrapping a load.

To achieve these and other advantages and in accordance with the purpose of the invention, as embodied and broadly described, the invention includes an apparatus for wrapping the sides of a load with packaging material including a load support surface for supporting the load during wrapping, a dispenser for dispensing packaging material, means for providing relative rotation between the dispenser and the load to wrap packaging material around the sides of the load, a packaging material holder for selectively holding and releasing a leading end of packaging material, and a support arm moveable above the load support surface for moving the packaging material holder between a radially outward position distant from the sides of the load and a radially inward position near the sides of the load.

According to another aspect of the present invention, the invention includes an apparatus for wrapping the sides of a load with packaging material including a dispenser for dispensing packaging material, means for providing relative rotation between the dispenser and the load to wrap packaging material around the load, and a packaging material holder with at least one vacuum cup for selectively holding and releasing a leading end of the packaging material.

According to a further aspect of the present invention, the invention includes an apparatus for wrapping a load with packaging material including a load support surface for supporting the load during wrapping, a dispenser for dispensing packaging material, means for providing relative rotation between the dispenser and the load to wrap packaging material around the load, a packaging material holder for selectively engaging and releasing a leading end of the packaging material, and a support arm connected to the packaging material holder for moving the packaging material holder and leading end of the packaging material from a packaging material engaging position distant from the sides of the load to a wrapping position near the sides of the load to wrap the packaging material about the sides of the load and the packaging material holder.

According to another aspect of the present invention, the invention includes an apparatus for wrapping a load with packaging material including a load support surface for supporting the load during wrapping, a dispenser for dispensing packaging material, means for providing relative rotation between the dispenser and the load to wrap packaging material around the load, a packaging material holder for selectively engaging and releasing a leading end of the packaging material, and a support arm connected to the packaging material holder for holding the packaging material holder and leading end of the packaging material in a wrapping position near the sides of the load to wrap the packaging material about the sides of the load and the packaging material holder and for moving the packaging material holder away from the sides of the load to release the packaging material after wrapping.

According to yet a further aspect of the present invention, the invention includes an apparatus for retaining and positioning a free end of packaging material to a load to be wrapped with a rotary stretch wrapping apparatus, including an unopposed packaging material holder moveable between a first position and a second position, a support arm for moving the packaging material holder between a position distant from the load to be wrapped and a position near the load to be wrapped, and a support frame for the support arm and configured to be mounted on or adjacent to a load support surface of a rotary stretch wrapping apparatus.

Additional features and advantages of the invention will be set forth in the description which follows, and in part will be apparent from the description, or may be learned by practice of the invention. The objects and other advantages of the invention will be realized and attained by the method and apparatus particularly pointed out in the written description and claims as well as the appended drawings.

It is to be understood that both the foregoing general description and the following detailed description are exemplary and explanatory and are intended to provide further explanation of the invention as claimed. The accompanying drawings are included to provide a further understanding of the invention and are incorporated in and constitute a part of the specification, illustrate an embodiment of the invention, and together with the description serve to explain the principles of the invention.

DETAILED DESCRIPTION OF THE PREFERRED EMBODIMENTS

Reference will now be made in detail to the present preferred embodiments of the present invention, examples of which are illustrated in the accompanying drawings.

According to the invention, an apparatus is provided for wrapping a load with packaging material. As embodied herein and shown in FIGS. 1–7 and 15, an apparatus for wrapping a load with packaging material includes stretch wrapping apparatus 100.

Figure 5B:
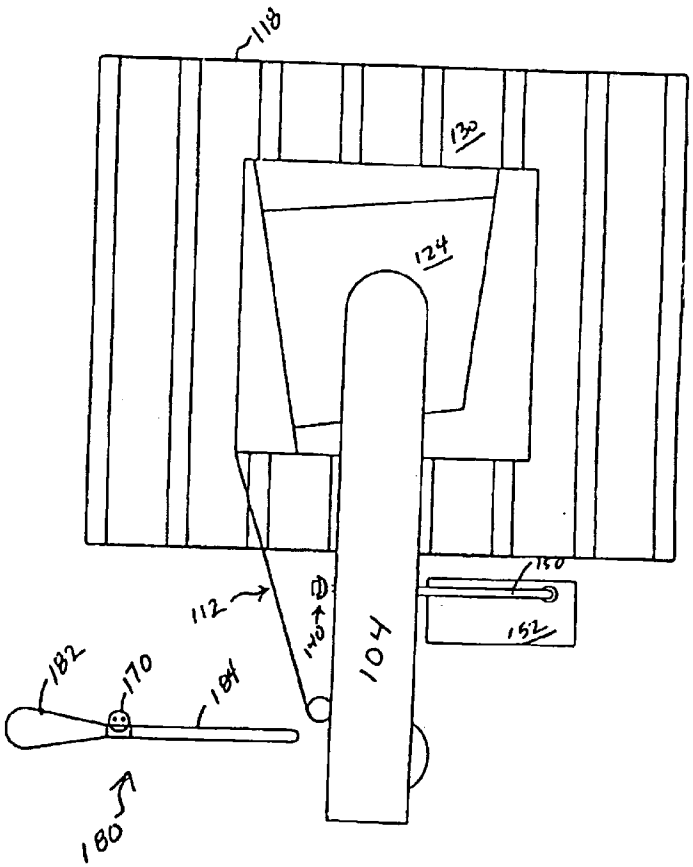
FIGS. 5A and 5B are a perspective view and a plan view, respectively, of the first embodiment of the stretch wrapping apparatus after the stretch wrap has been wrapped around the load.
Figure 5A:
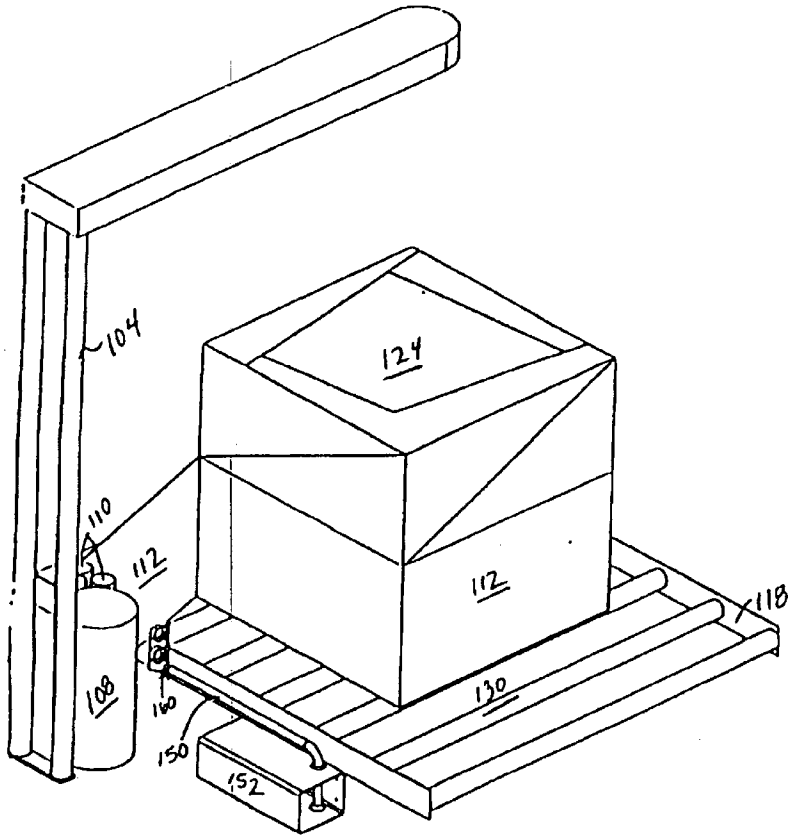
Figure 6B:
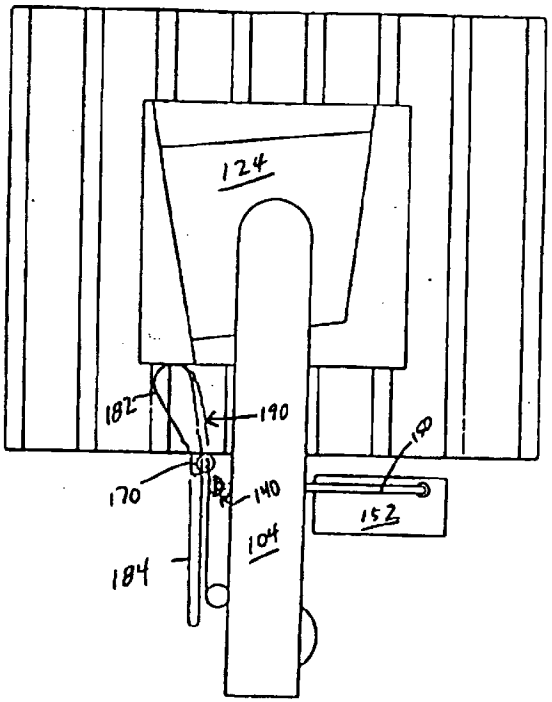
FIGS. 6A and 6B are a perspective view and a plan view, respectively, of the first embodiment of the stretch wrapping apparatus after the load has been wrapped and the stretch wrap cut.
Figure 6A:
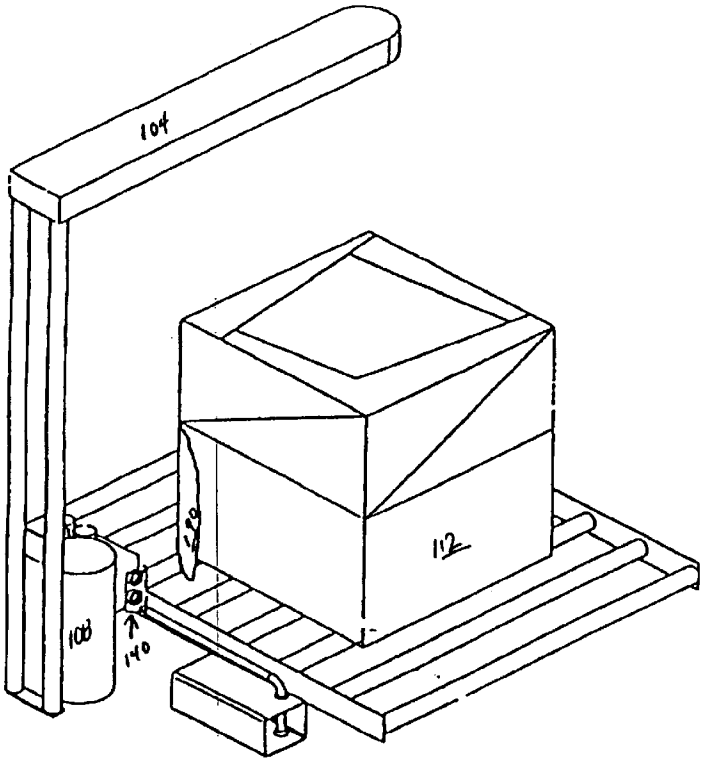
Figure 7B:
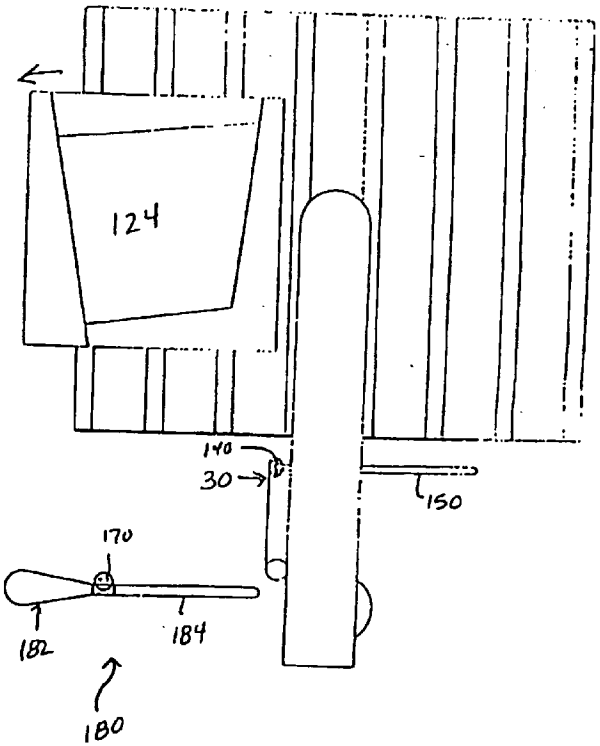
FIGS. 7A and 7B are a perspective view and a plan view, respectively, of the first embodiment of the stretch wrapping apparatus with the packaging material holder in the "home" position after the load has been wrapped and conveyed out of the wrapping area.
Figure 7A:
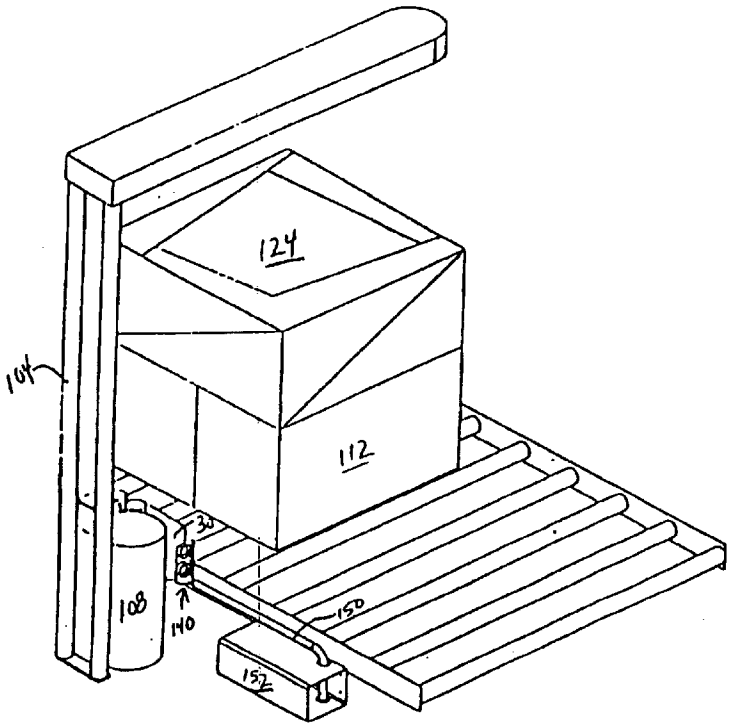
Figure 8:
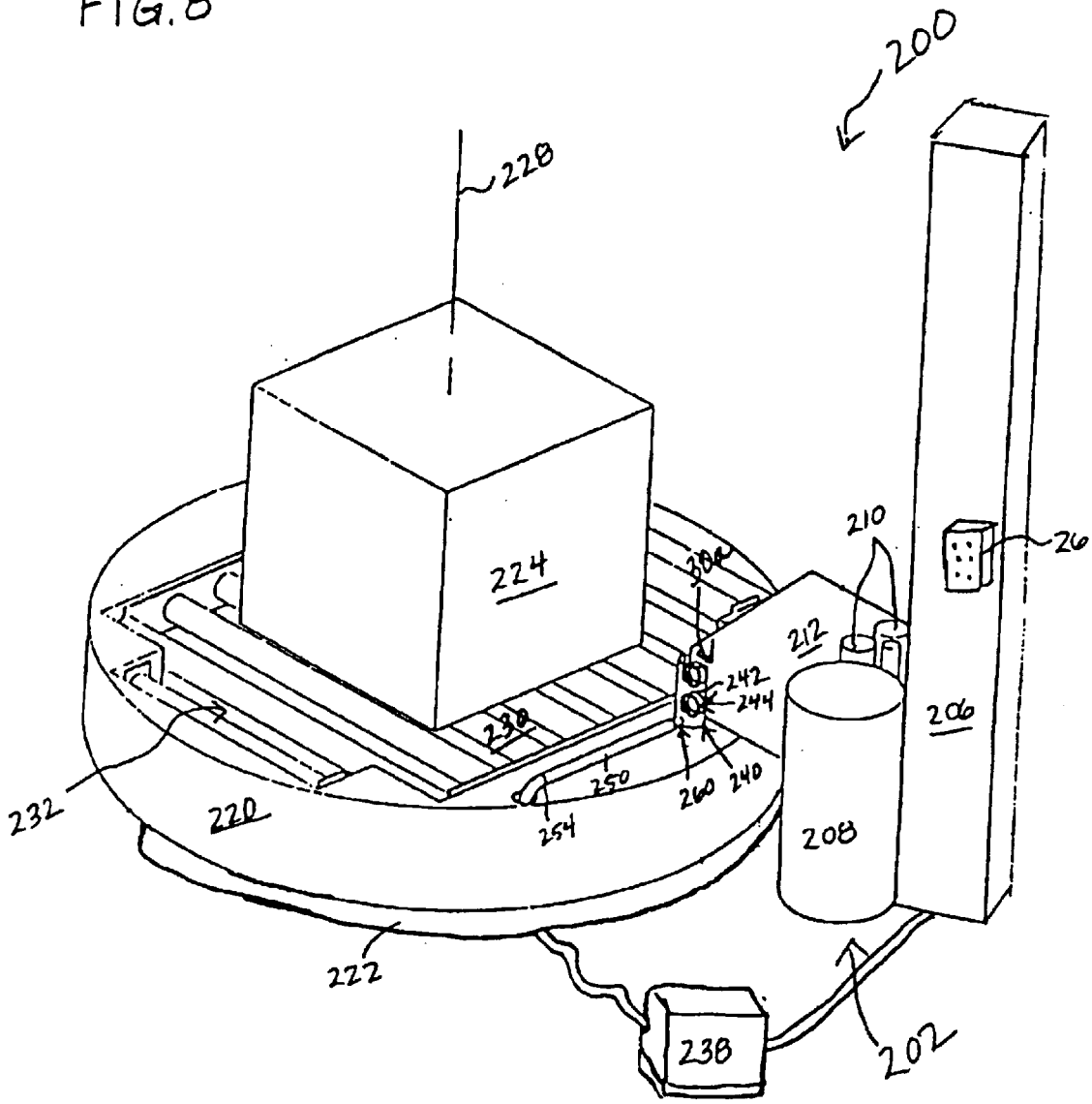
FIG. 8 is a perspective view of a stretch wrap packaging apparatus according to a second embodiment of the present invention.

According to the present invention, a packaging material holder for selectively holding and releasing a leading end of the packaging material is provided. As embodied herein and shown in FIGS. 1–7 and 15, packaging material holder 140 has an unopposed surface for selectively engaging and releasing a leading end 30 of packaging material 112. As shown in FIGS. 6B and 7B, the unopposed surface of the packaging material holder 140 engages a single side of packaging material 112, rather than clamping or trapping the packaging material 112 between opposing surfaces. The unopposed surface of packaging material holder 140 may be a tacky, adhesive-like surface, a prickly surface, an irregular surface, or a vacuum surface. Packaging material holder 140 may be a relatively short element, sized to contact only a portion of the width of the packaging material 112. Alternatively, packaging material holder 140 may be sized to extend across the entire width of the packaging material 112. Packaging material holder 140 may be made of any suitable material, such as metal or plastic, and may be formed in any suitable shape, such as a bar, a square, a rectangle or a circle. It is preferable, however, that packaging material holder 140 be relatively small in size in order to facilitate moving packaging material holder 140 out from between load 124 and packaging material 112. According to some other aspects of the invention, holders with opposed surfaces, such as traditional clamps, may be used.

Figure 15B:
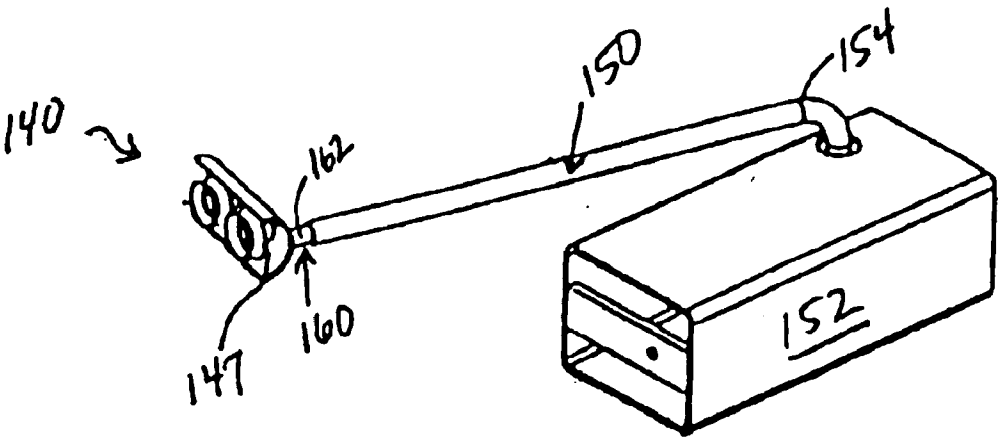
FIGS. 15A and 15B are perspective views of the packaging material holder of the present invention for retrofitting a stretch wrapping apparatus used in the first and second embodiments of the present invention.
Figure 15A:
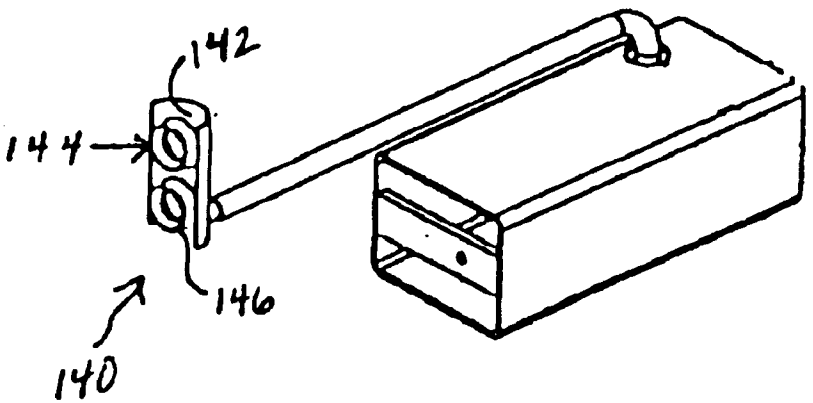
Figure 16:
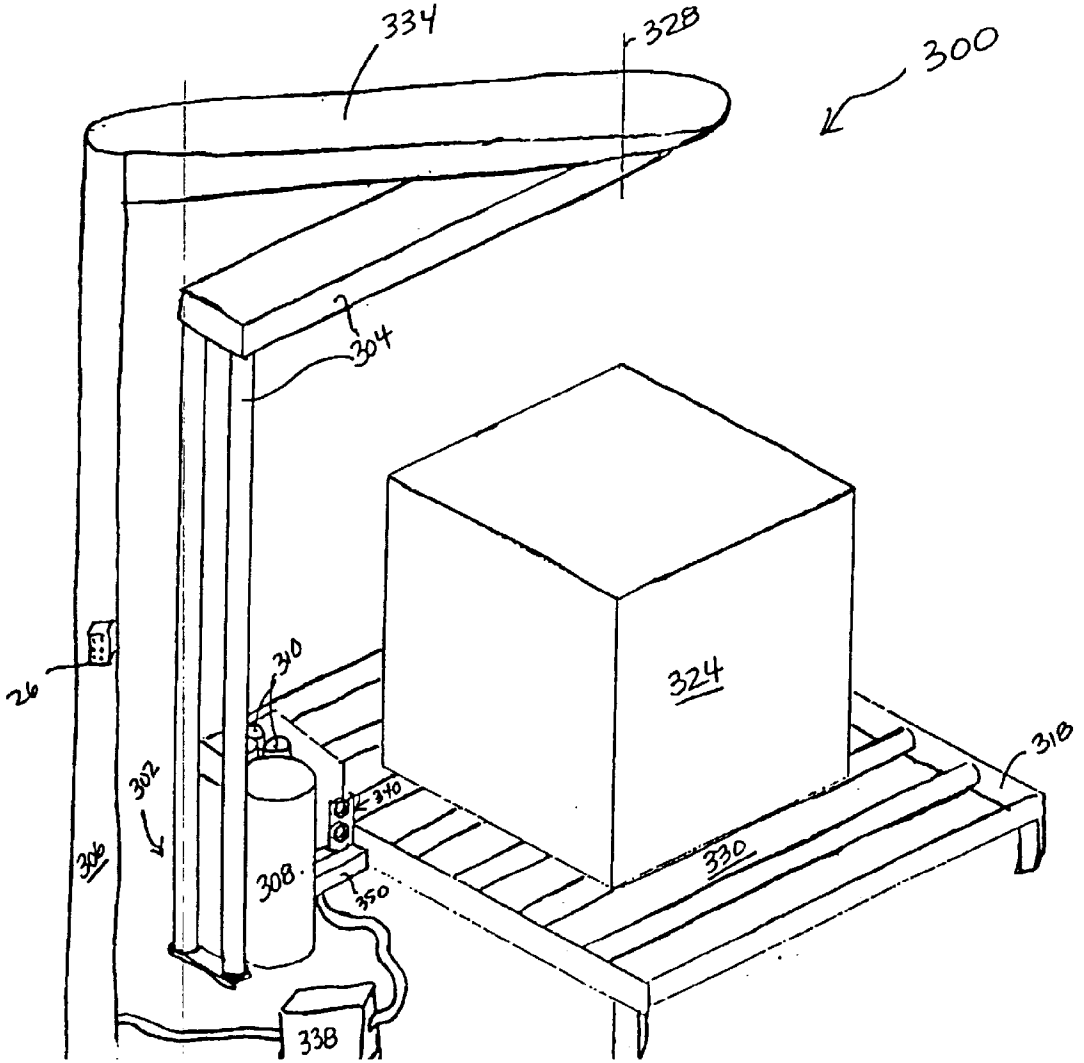
FIGS. 16–20 are perspective views of a third embodiment of the stretch wrap packaging apparatus of the present invention showing positioning of the packaging material holder at different points during the wrapping sequence.
Figure 21:
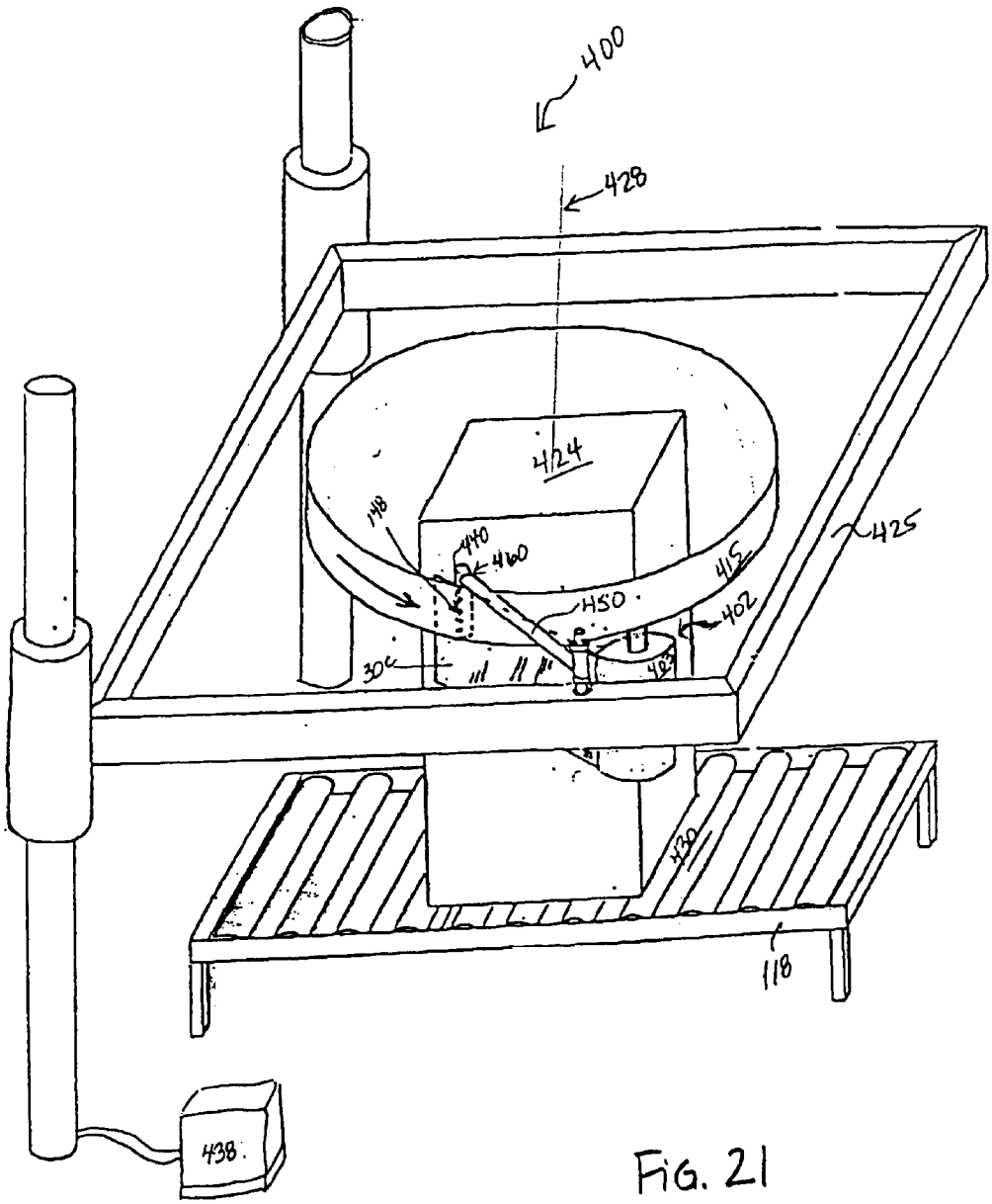
FIGS. 21 and 22 are perspective views of a fourth embodiment of the stretch wrap packaging apparatus of the present invention showing positioning of the packaging material holder at different points during the wrapping sequence.

In a preferred embodiment, as shown in FIG. 15, packaging material holder 140 may include a vacuum surface 142 for holding and releasing the leading end 30 of packaging material 112. Vacuum surface 142 may include suction holes 148 (as shown in FIG. 21), or vacuum surface 142 may include at least one suction or vacuum cup 144. Vacuum surface 142 is preferably curved in shape to accommodate vacuum cup 144. Vacuum cup 144 includes a raised lip area 146 for contacting the packaging material 112 as well as a concave or cup-shaped body portion 147 which sits within vacuum surface 142.

Packaging material holder 140 includes an automatic valving to vacuum and pressure source 138 which is connected to the packaging material holder 140 for providing a vacuum through surface 142 and/or vacuum cups 144 to adhere the packaging material 112 to the packaging material holder 140, and for stopping the application of a vacuum, or supplying a positive flow of air through vacuum surface 142 to release and blow the packaging material away from the packaging material holder 140. Automatic valving to vacuum and pressure source 138 is controlled by a controller 26 which includes a microprocessor or other control circuitry which provides timing functions in a manner conventional with stretch wrapping machines.

Figure 1:
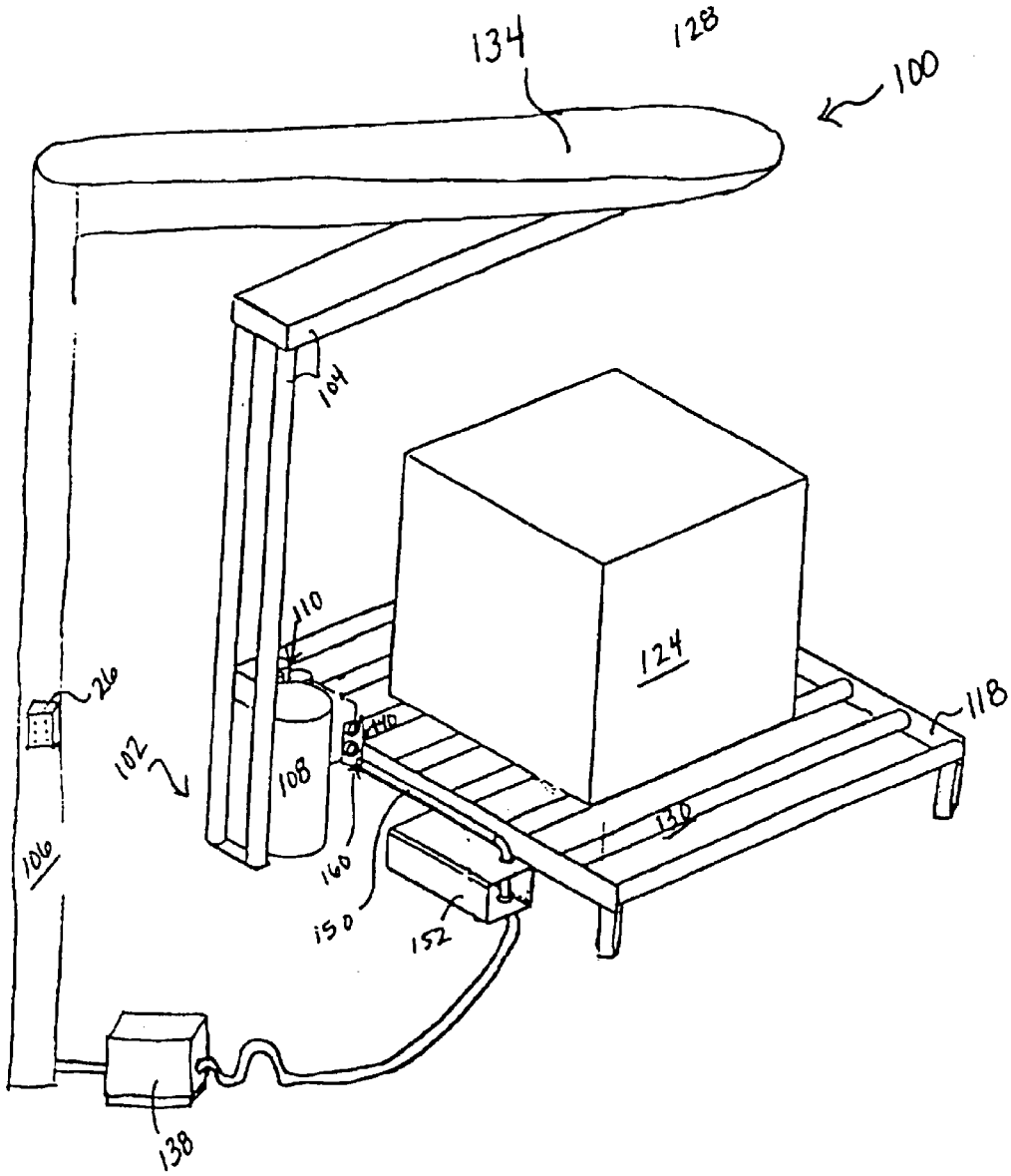
FIG. 1 is a perspective view of a stretch wrap packaging apparatus according to a first embodiment of the present invention.

According to the present invention, a support arm for moving the packaging material holder is provided. As embodied herein and as shown in FIGS. 1–7, support arm 150 supports packaging material holder 140. As shown in FIG. 1, support arm 150 includes a metal tube. However, the arm can include other structures which support and move the packaging material holder 140, such as a bar, a frame, a wire structure, or a truss. Additionally, support arm 150 may be made from any suitable material strong enough to support and move packaging material holder 140, such as wood or other fibrous materials, plastics, metals, or composites of any of these materials.

Support arm 150 is moveable between a position distant from the sides of the load 124 and near the packaging material dispenser 102 and a position near a side of the load 124 to be wrapped. In a preferred embodiment, packaging material holder 140 is moveable on support arm 150 between a position distant from the load and adjacent the packaging material dispenser (hereinafter referred to as the distant position) and a position touching or close to a side of the load (hereinafter referred to as the near position). With respect to an axis of rotation for wrapping the load, the distant position is a radially outward position distant from the load and the near position is a radially inward position near a side of the load. According to one aspect of the present invention, the near and distant positions may be defined with respect to a circle circumscribed about the corners of a load 124 to be wrapped. The interior area of the circle is the area into which packaging material holder 140 and support arm 150 pass to reach the near position. In contrast, when packaging material holder 140 and support arm 150 are outside this circle, they are in the distant position. Support arm 150 may be rotatable between these positions, as shown in FIGS. 1–7.

Figure 2:
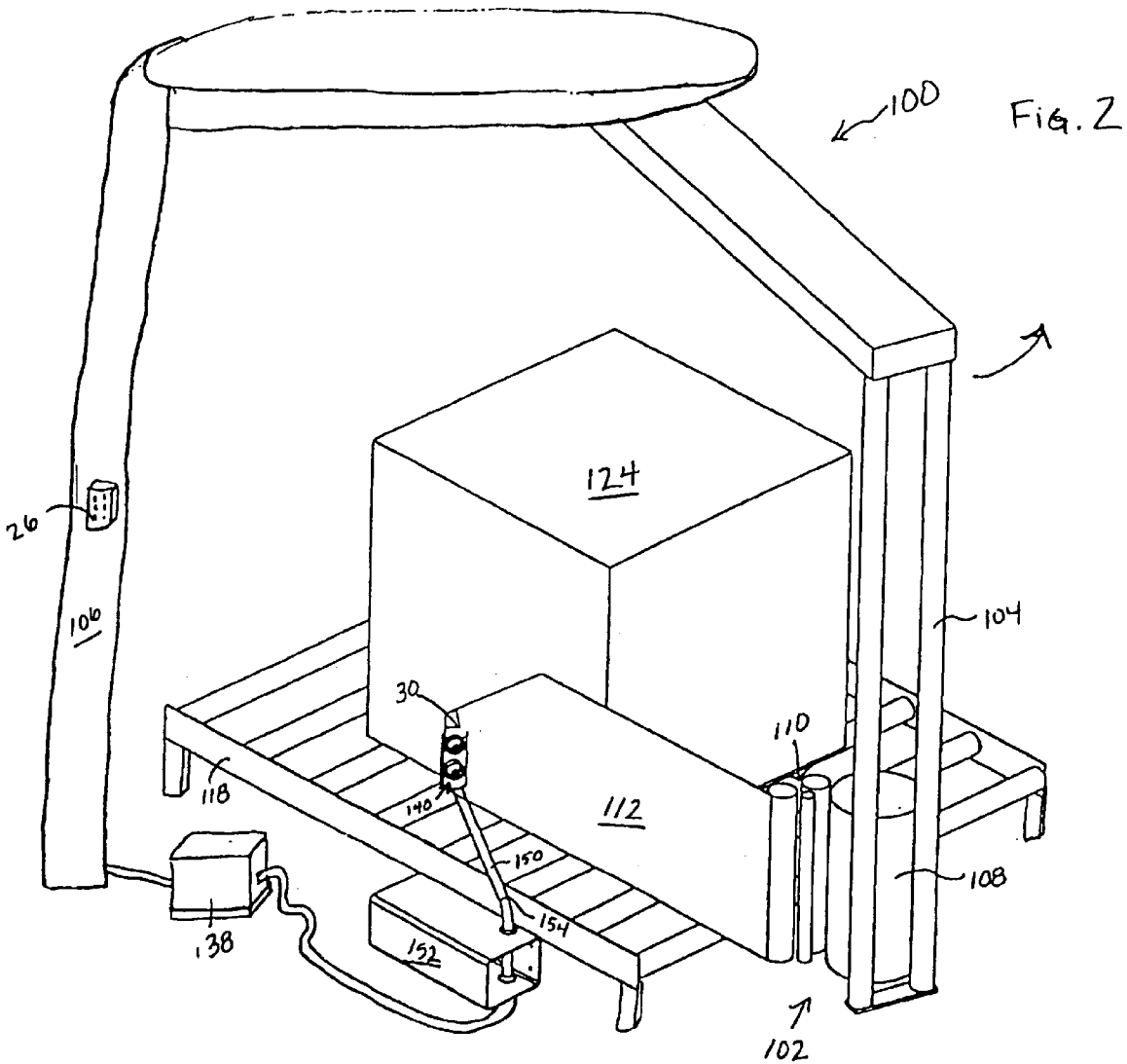
FIGS. 2–4 are perspective views of a stretch wrap packaging apparatus of the first embodiment of the present invention showing positioning of the packaging material holder at different points during the wrapping sequence.

Support arm 150 is moveable above a load support surface 130. As embodied herein, load support surface 130 is the surface which supports load 124 during the wrapping process. As shown in FIGS. 1 and 2, the load support surface is the portion of conveyor 118 within the wrapping area upon which the load rests during wrapping. Alternatively, load support surface 130 may be the floor, a portion of a turntable, or any other surface upon which the load rests on, as opposed to below that surface, during wrapping.

Support arm 150 is moveable above the load support surface 130 between the distant position and the near position. Support arm 150 may be moveable in a horizonal plane above load support surface 130 or support arm 150 may slide on top of load support surface between the distant and near positions. Movement of support arm 150 between the distant position and the near position may be controlled by an air cylinder actuated by controller 26. In a preferred embodiment, only the motion of support arm 150 moving from the near position to the distant position is actuated by an air cylinder, and the motion of support arm 150 from the distant position to the near position is driven solely by the force exerted on packaging material holder 140 by packaging material 112 as the wrapping cycle begins.

As shown in FIGS. 1–7 and 15, a first end of support arm 150 may be supported by a support frame 152 placed adjacent to a load support surface during wrapping. As seen in FIGS. 1–7 and 15, support arm 150 may be cantilevered to be positionable and moveable above the load support surface, in contrast to resting on the load support surface. According to this aspect of the invention, support arm 150 is not configured to be positionable under or moveable upward through the load support surface.

Figure 4:
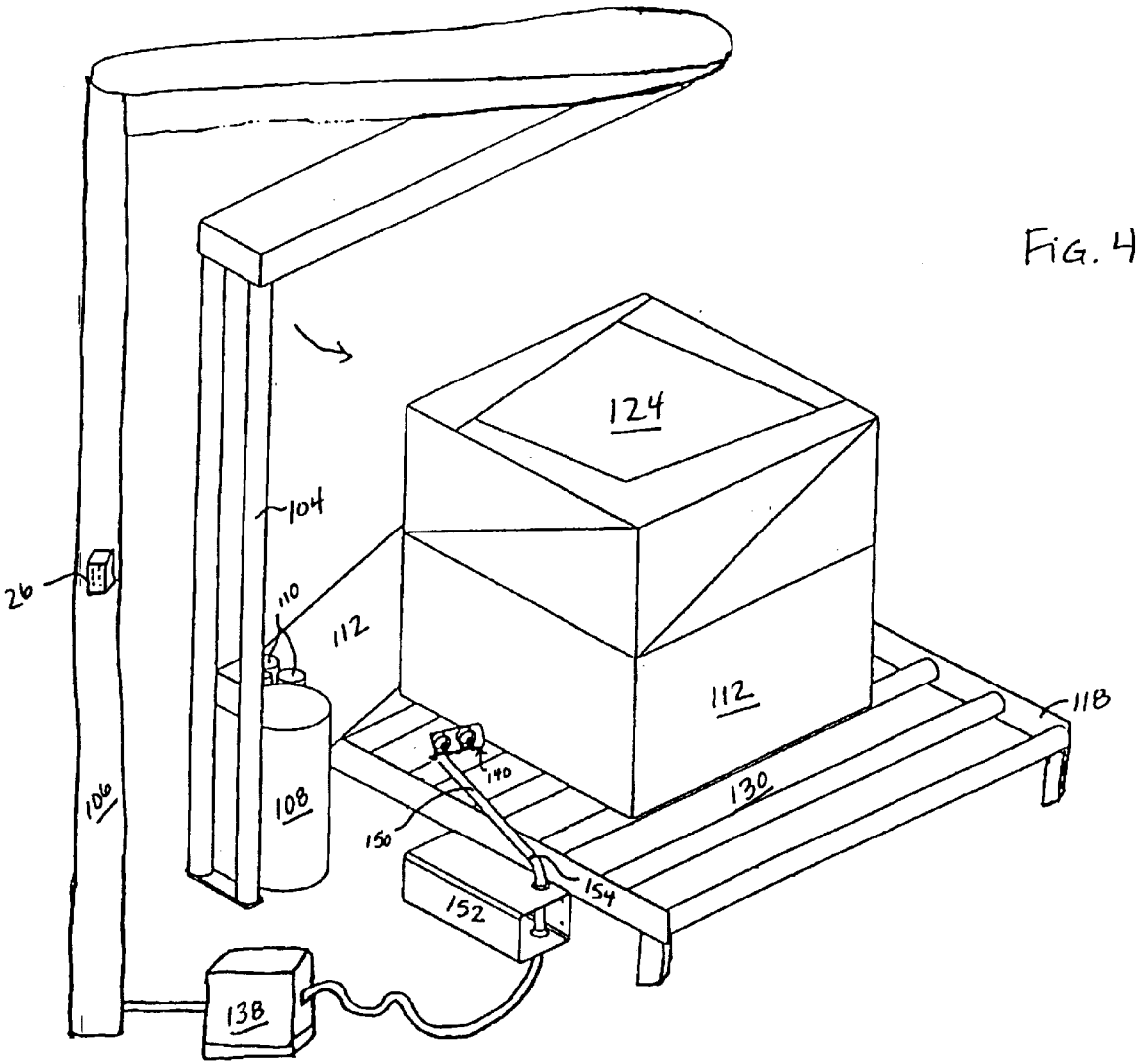

A second end of support arm 150 is connected to and supports packaging material holder 140. As shown in FIG. 4, support arm 150 may be flexibly connected to packaging material holder 140. Alternatively, support arm 150 may be rigidly connected to packaging material holder 140. As shown in FIG. 1, support arm 150 may support packaging material holder 140 in an upright position above support arm 150 such that packaging material holder 140 holds the packaging material above the support arm 150. Support arm 150 and packaging material holder 140 are thus arranged such that packaging material holder 140 holds the packaging material 112 away from support arm 150 so that support arm 150 does not engage the packaging material or interfere with the wrapping process.

Support arm 150 may include a shoulder 154, as shown in FIG. 1, for allowing support arm 150 to rotate about its principal axis. If packaging material holder 140 is rigidly connected to support arm 150, it may rotate together with support arm 150 as it rotates about its principal axis. Alternatively, support arm 150 may not be rotatable about its principal axis, and packaging material holder 140 and support arm 150 may rotate together about an axis generally perpendicular to the principal axis of support arm 150, resulting in a general "shoehorn" type of motion. In this case, a "shoehorn" motion means a generally curved upward and outward (i.e., away from the load) motion.

Alternatively, packaging material holder 140 may be connected to support arm 150 by a wrist portion 160. Wrist portion 160 may include a rod 162 of smaller diameter than support arm 150 which fits within support arm 150 and is attached to packaging material holder 140 to provide rotation of packaging material holder 140 relative to support arm 150 (see FIG. 15). Alternatively, wrist portion 160 may be flexible and include a spring located between and attached to support arm 150 and packaging material holder 140 to allow packaging material holder 140 to rotate relative to support arm 150. Rotation of wrist portion 160 may be actuated by an air cylinder or piston, or rotation may be driven by unpowered force such as movement of support arm 150 by pulling away from packaging material holder 140. Wrist portion 160 may include any suitable device for providing articulation between support arm 150 and packaging material holder 140 such as a hinge, a ball, or a ball and socket combination. Wrist portion 160 may be made from any material which provides the necessary strength and flexibility to allow articulation between support arm 150 and packaging material holder 140 while facilitating the support of packaging material holder 140 on support arm 150. Examples of suitable materials are metals, plastics, rubbers, and other polymers.

According to the present invention, a dispenser is provided for dispensing packaging material. As shown in FIG. 2, packaging material dispenser 102 dispenses a sheet of packaging material 112 in a web form. Packaging material dispenser 102 includes a roll of packaging material contained within a roll carriage 108 and may also include a variety of rollers 110, optionally including prestretch rollers for stretching the packaging material longitudinally and/or transversely, to position, dispense, and stretch the packaging material as packaging material 112 is being dispensed from the roll of packaging material. Roll carriage 108 of dispenser 102 is vertically moveable on arm 104 to dispense packaging material 112 spirally about load 124 as arm 104 rotates about load 124. In a preferred embodiment, stretch wrap packaging material is used, however, various other packaging materials such as netting, strapping, banding, or tape can be used as well.

According to the present invention, the apparatus includes means for providing relative rotation between the dispenser and the load to wrap packaging material around the load. As shown in FIGS. 1 and 2, the means for providing relative rotation between the dispenser and the load may include an arrangement in which film dispenser 102 revolves around load 124, so that the dispenser may be carried by a ring or arm or other arrangement. As embodied in FIGS. 1 and 2, the means for providing the relative rotation includes a L-shaped arm 104 for supporting and rotating roll carriage 108 of film dispenser 102 in a circle about a vertical axis 128 and about load 124 sitting on a load support surface 130. L-shaped arm 104 is rotated by a motor driven bearing 134 which drives L-shaped arm 104 and dispenser 102 around a load 124. Load support surface 130 is preferably a portion of the surface of conveyor 118 but may include other suitable surfaces such as the floor or a portion of a turntable surface. The relative rotation may occur about a vertical axis as shown for pallet loads, or may occur around a horizontal axis for bundling operations.

According to one aspect of the present invention, the apparatus may include means for severing the packaging material between the load and the packaging material holder while holding the packaging material with the packaging material holder. As shown in FIGS. 5B, 6B, and 7B, the means for severing includes a cutting mechanism 170, which may include a hot wire or knife, which acts to heat and sever the film by heating when pulsed with electricity as directed by controller 26. The severing means may be mounted on mast 106, on film dispenser 102, or in any other suitable location.

According to one aspect of the present invention, the apparatus may include a film wipedown mechanism for wiping a film tail onto the load after the packaging material has been cut. As embodied herein and shown in FIGS. 5B, 6B, and 7B, the film wipedown mechanism 180 includes wipe loops 182 and a wipe arm 184. In a preferred embodiment, cutting mechanism 170 is mounted on wipe arm 184 to allow the film tail 190 to be wiped onto load 124 as the packaging material 112 is cut.

According to another embodiment of the present invention shown in FIGS. 8–14, in which similar numerals designate similar components, an apparatus for wrapping a load with packaging material includes stretch wrapping apparatus 200. As shown in FIGS. 8–14, packaging material dispenser 202 is mounted on a stationary mast 206 upon which roll carriage 208 containing a roll of packaging material can be vertically positioned to dispense packaging material 212 from dispenser 202 to wrap load 224 as it rotates. Again, roll carriage 208 may include a frame, a film roll support, and a variety of rollers 210, optionally including prestretch rollers, to position, dispense, and stretch the packaging material as packaging material 212 is being dispensed from a roll of packaging material.

In this second embodiment of the present invention, the means for providing relative rotation include a motor driven turntable 220 mounted on base 222 to rotate load 224 about a vertical axis 228. The turntable 220 includes a load support surface 230 upon which the load is supported as it is wrapped and preferably includes conveying means 232 for conveying load 224 into and out of the wrapping area.

The packaging material holder 240 is similar to packaging material holder 140 as described with respect to FIGS. 1–7 and 15. Support arm 250 also may be similar to support arm 150 as described with respect to FIGS. 1–7 and 15. Alternatively, and as embodied in FIG. 8, a first end of support arm 250 may be located on turntable 220, to one side of load support surface 230. Support arm 250 supports packaging material dispenser 240 in the manner discussed above, and support arm 250 and packaging material holder 240 may be moveable together or relative to one another as discussed above with respect to FIGS. 1–7 and 15.

The packaging material wipedown mechanism 280 and means for severing the packaging material 270 are similar to packaging material wipedown mechanism 180 and severing means 170 as described with respect to FIGS. 1–7 above. Alternatively, wipedown mechanism 280 may be mounted on the floor, or on mast 206.

According to a third embodiment of the present invention shown in FIGS. 16–20, in which similar numerals designate similar components, an apparatus for wrapping a load with packaging material includes stretch wrapping apparatus 300. As shown in FIGS. 16–20, the dispenser 302 for dispensing packaging material is similar to dispenser 102 as described with respect to FIGS. 1–7 and the means for providing relative rotation between the dispenser 302 and the load 324 to wrap packaging material 312 around the load 324 is similar to the means for providing relative rotation between dispenser 102 and load 124 as discussed with respect to the first embodiment of the invention.

Figure 17:
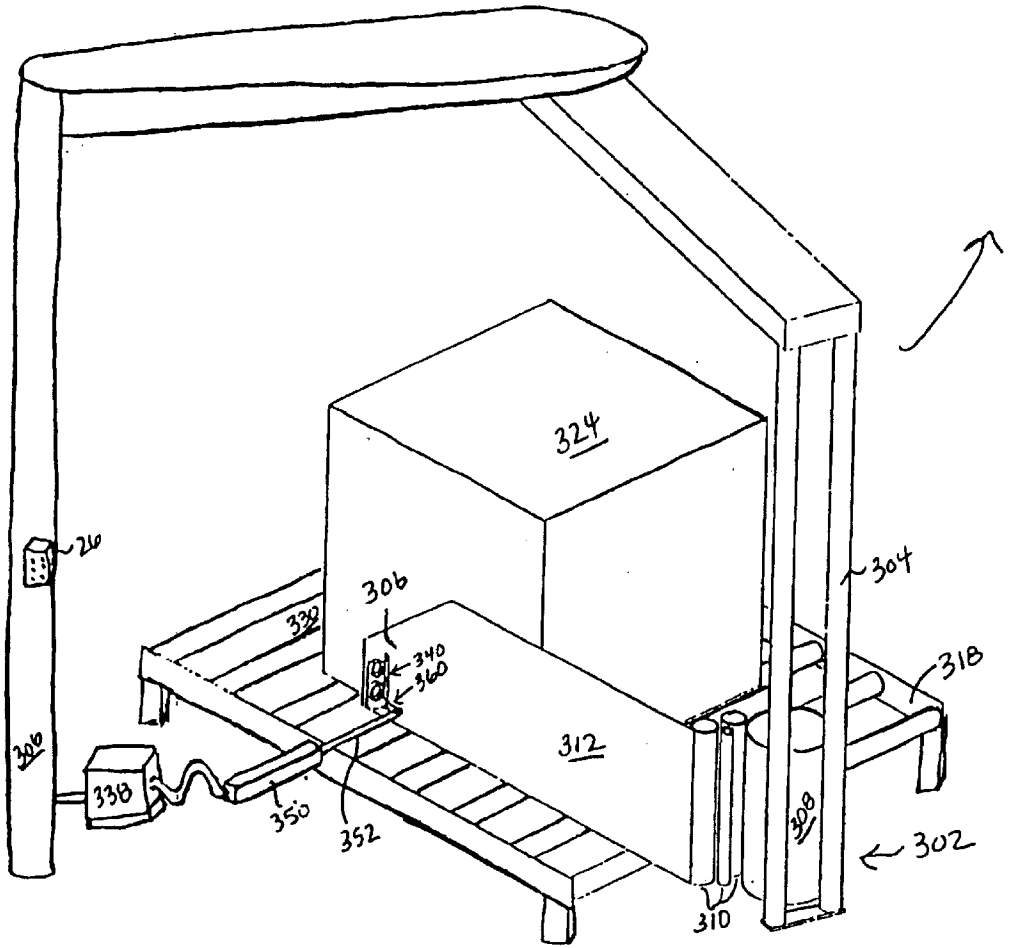

The packaging material holder 340 is similar to packaging material holder 140 as described with respect to FIGS. 1–7 and 15. Support arm 350 also may be similar to support arm 150 as described with respect to FIGS. 1–7 and 15. Alternatively, and as embodied in FIGS. 16–20, a first end of support arm 350 may be attached to mast 306 or dispenser 302 and support arm 350 may extend linearly between the radially inward and outward positions. As shown in FIG. 17 and embodied herein, support arm 350 may include an extensible support arm portion 352 which may fit into and be extensible from support arm 350 over load support surface 330 to move packaging material holder 340 between the radially outward position and the radially inward position.

Alternatively, extensible support arm portion 352 may move between the radially outward position and radially inward position in a variety of ways. For example, extensible support arm portion 352 may slide upon the top or bottom surface of support arm 350, slide within a groove in the top or bottom surface of support arm 350, fold into and out from a portion of support arm 350, or rotate to and from a portion of support arm 350. Extensible support arm portion 352 may be made of any material suitable for supporting and moving packaging material holder 340 to and from the load. Examples of such materials include plastics, metals, and other composite materials.

Extensible support arm portion 352 may be rotatable relative to support arm 350 about its principal axis. If packaging material holder 340 is rigidly connected to extensible support arm portion 352, it may rotate together with extensible support arm portion 352 relative to support arm 350. Alternatively, extensible support arm portion 352 may not be rotatable about its principal axis, and packaging material holder 340, support arm 350, and extensible support arm portion 352 may rotate together about an taxis generally perpendicular to the principal axis of support arm 350, resulting in a general "shoehorn" type of motion as heretofore described.

Alternatively, packaging material holder 340 may be connected to extensible support arm portion 352 by a flexible wrist portion 360. In this embodiment, wrist 360 is located between extensible support arm portion 352 and packaging material holder 340. Wrist 360 may be similar to wrist 160 as described with respect to FIGS. 1–7 and 15. Wrist portion 360 may include a rod 362 of smaller diameter than support arm 350 attached to extensible support arm portion 352 and attached to packaging material holder 340 to provide rotation of packaging material holder 340 relative to support arm 350 and extensible support arm portion 352 (see FIG. 17). Wrist portion 360 may include a spring located between and attached to extensible support arm portion 352 and packaging material holder 340 to allow packaging material holder 340 to rotate relative to support arm 350 and extensible support arm portion 352. Rotation of wrist portion 360 may be actuated by an air cylinder or piston, or rotation may be driven by unpowered force such as movement of extensible support arm portion 352 by pulling away from packaging material holder 340.

The packaging material wipedown mechanism 380 and means for severing the packaging material 370 are similar to packaging material wipedown mechanism 180 and severing means 170 as described with respect to FIGS. 1–7 above.

Figure 22:
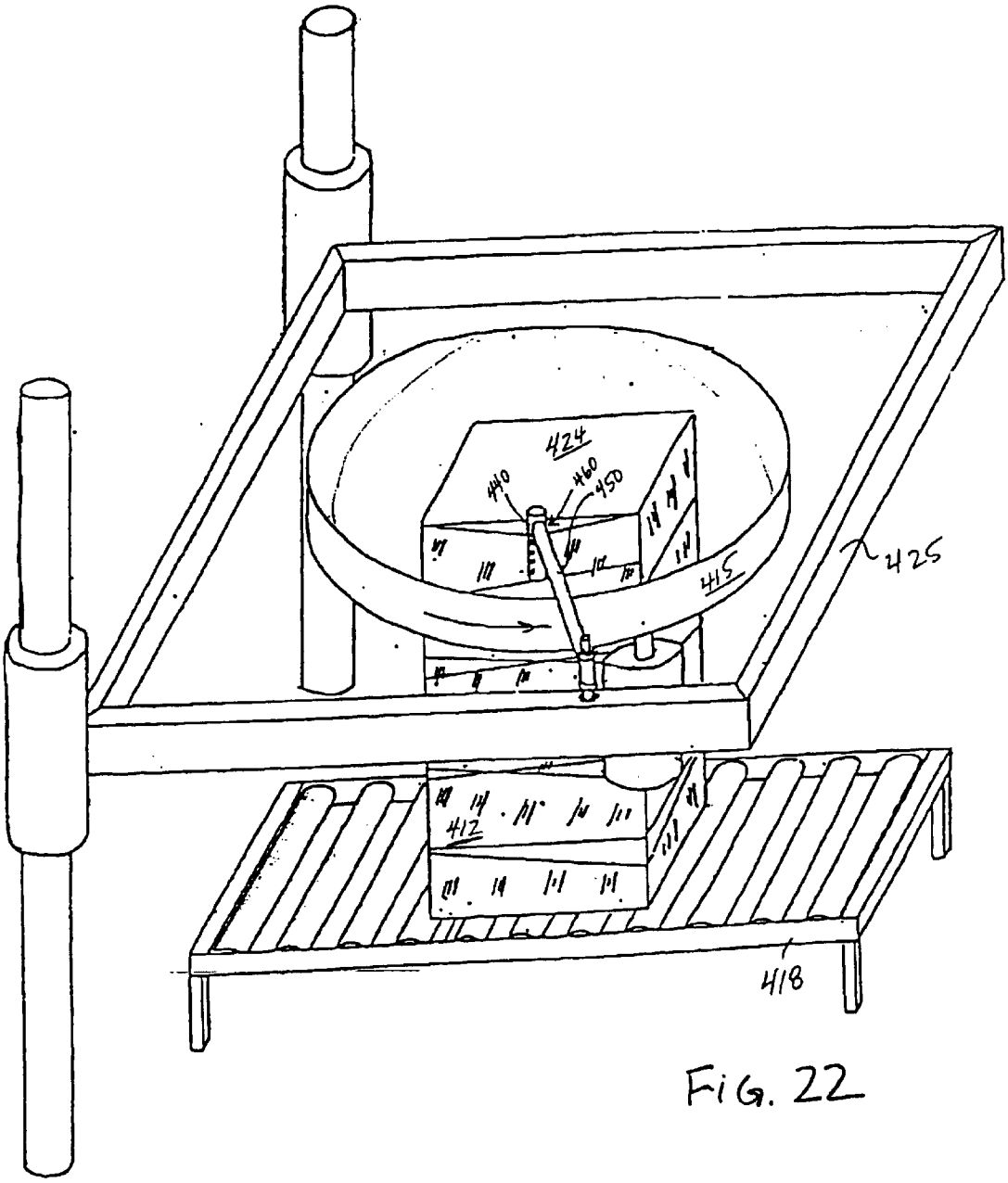

According to a fourth embodiment of the invention shown in FIGS. 21 and 22, in which similar numerals designate similar components, an apparatus for wrapping a load with packaging material includes stretch wrapping apparatus 400. According to this embodiment of the present invention, a dispenser for dispensing packaging material and means for providing relative rotation between the dispenser and the load to wrap packaging material around the load are provided. As shown in FIGS. 21 and 22, the dispenser 402 includes a roll of packaging material 403 mounted on a ring 415 which is supported by a vertically moveable frame 425. The roll of packaging material 403 rotates about a vertical axis 428 as the frame 425 moves up and down to spirally wrap packaging material 412 about the load 424. Load 424 can be manually placed in the wrapping area or conveyed into the wrapping area by conveyor 418. Packaging material holder 440 is mounted on frame 425, and is moveable above conveyor 418, which serves as a load support surface 430 in the wrapping area, between a radially outward position distant from a side of the load to a radially inward position near a side of the load.

Packaging material holder 440 is similar to packaging material holder 140 as described with respect to FIGS. 1–7 and 15. Alternatively, in this embodiment, packaging material holder 440 may be mounted on support arm 450 such that packaging material holder 440 holds the packaging material below support arm 450 and out of the way of rotating wrapping ring 415 during the wrapping process. Support arm 450 also may be similar to support arm 150 as described with respect to FIGS. 1–7 and 15. Alternatively, support arm 450 may be mounted on vertical frame 425 as shown in FIG. 21.

The fourth embodiment of the present invention may also include a packaging material wipedown mechanism and means for severing the packaging material similar to packaging material wipedown mechanism 180 and severing means 170 as described with respect to FIGS. 1–7 above.

A method for wrapping a load according to the present invention is shown in FIGS. 1–7. As shown and according to a preferred embodiment of the present invention, a load 124 is conveyed by a conveyor 118 to a load support surface 130 in the wrapping station. A leading end portion 30 of a sheet of packaging material 112, preferably stretch wrap packaging material, is engaged by the vacuum cups 144 on unopposed surface 142 of the packaging material holder 140. Motor driven rotating L-shaped arm 104 begins to rotate film dispenser 102 in a circle about a vertical axis 128 and about load 124 sitting on load support surface 130. As arm 104 and dispenser 102 rotate about axis 28, the force exerted upon packaging material holder 140 by leading end portion 30 of packaging material 112 causes packaging material 112 and packaging material holder 140 on supporting arm 150 to move above the load support surface 130 (the portion of conveyor 118 in the wrapping area) from a radially outward position distant from the sides of the load to a radially inward position near the sides of the load as shown in FIG. 2. In a preferred embodiment, the packaging material holder 140 will continue to move toward the sides of the load until it touches a side of the load, thus stopping the movement of the packaging material holder 140.

Figure 3:
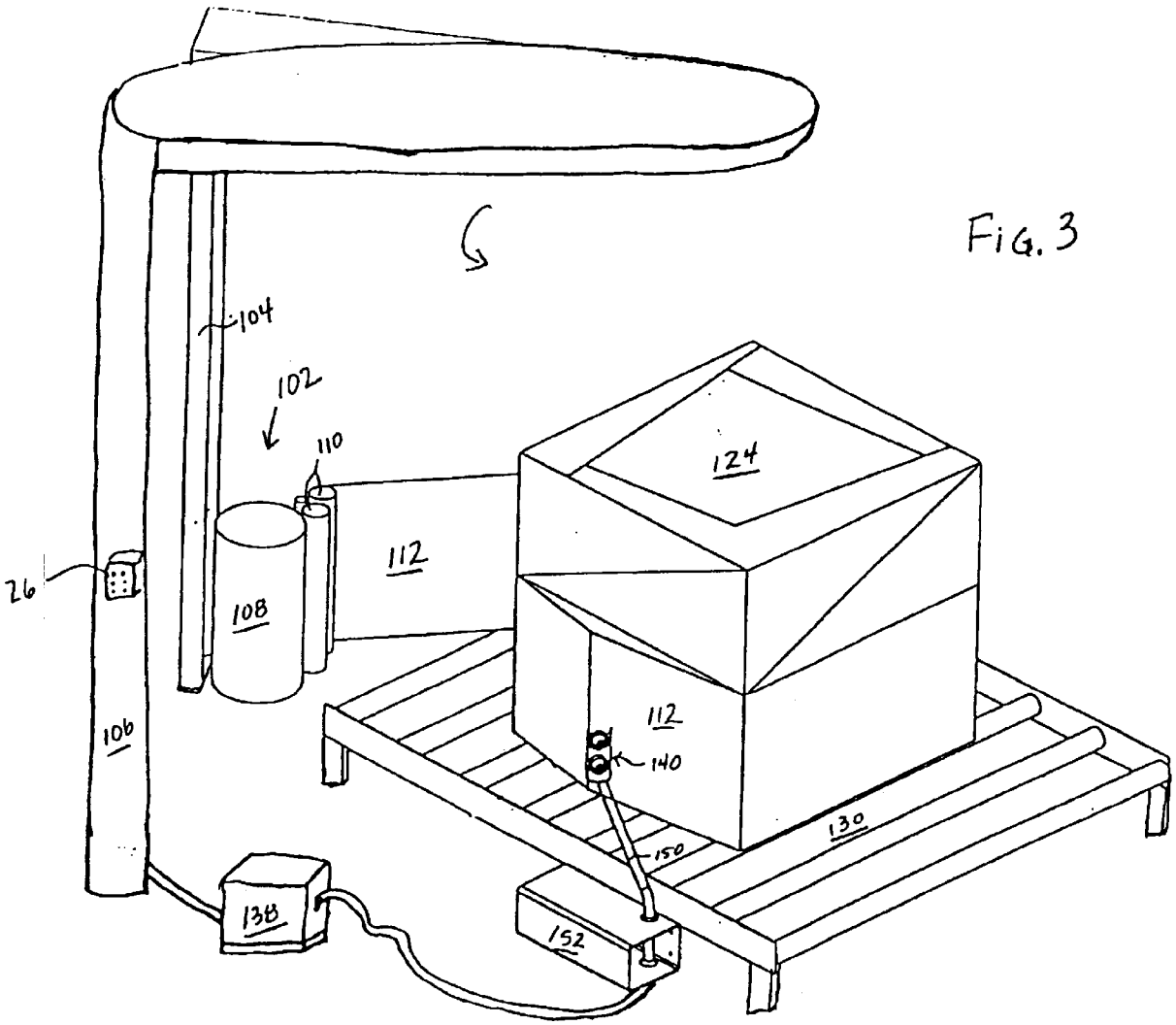

As the packaging material holder reaches the near position, dispenser 102 and arm 104 continue to rotate about load 124, dispensing and wrapping packaging material 112 about load 124 and packaging material holder 140 near the load (see FIG. 3). After load 124 is wrapped and arm 104 and dispenser 102 have returned to a "home" position, over-wrapped packaging material holder 140 releases the leading end 30 of packaging material and rotates relative to load 124 to move from between packaging material 112 and load 124 as shown in FIG. 4. If packaging material holder 140 is employing a vacuum surface 142, controller 26 stops the vacuum and supplies a positive flow of air to blow packaging material 112 away from vacuum surface 142 and vacuum cups 144.

As shown in the embodiment in FIG. 4, packaging material holder 140 rotates on a flexible wrist portion 160 relative to support arm 150, and by this rotation moves out from between the load 124 and packaging material 112. If the flexible wrist portion includes a spring, movement of support arm 150 away from the wrapped load toward the distant position will generate a force sufficient to cause packaging material holder 140 to rotate relative to the load 124 and support arm 150 to move packaging material holder 140 from between load 124 and packaging material 112.

Alternatively, if packaging material holder 140 is rigidly connected to support arm 150, both packaging material holder 140 and support arm 150 may rotate together along the principal axis of support arm 150 on shoulder 154 to move packaging material holder 140 out from between the load 124 and packaging material 112. In an alternative embodiment, where packaging material holder 140 is rigidly connected to support arm 150, both packaging material holder 140 and support arm 150 may rotate together relative to the side of the load about an axis generally perpendicular to the principal axis of support arm 150 to slide packaging material holder 140 out from between the load 124 and packaging material 112 in a "shoehorn" type of motion.

After packaging material holder 140 moves from between load 124 and packaging material 112, support arm 150 and packaging material holder 140 move away from the load to the distant position. At this point, controller 26 actuates packaging material cutter 170 and wipedown mechanism 180. Packaging material cutter 170 and wipe-loops 182 of wipedown mechanism 180 extend and press packaging material 112 into packaging material holder 140, at which time the vacuum cups 144 on vacuum surface 142 are actuated to engage packaging material 112. The packaging material is severed by packaging material cutter 170, the trailing end 190 of packaging material may be secured to the load and wiped down by the wipedown mechanism 180, and the wrapped load is conveyed out of the wrapping area.

All of the functions can be controlled with a typical programmed microprocessor or other controller devices which are conventionally used with the stretch wrapping apparatus.

Figure 9:
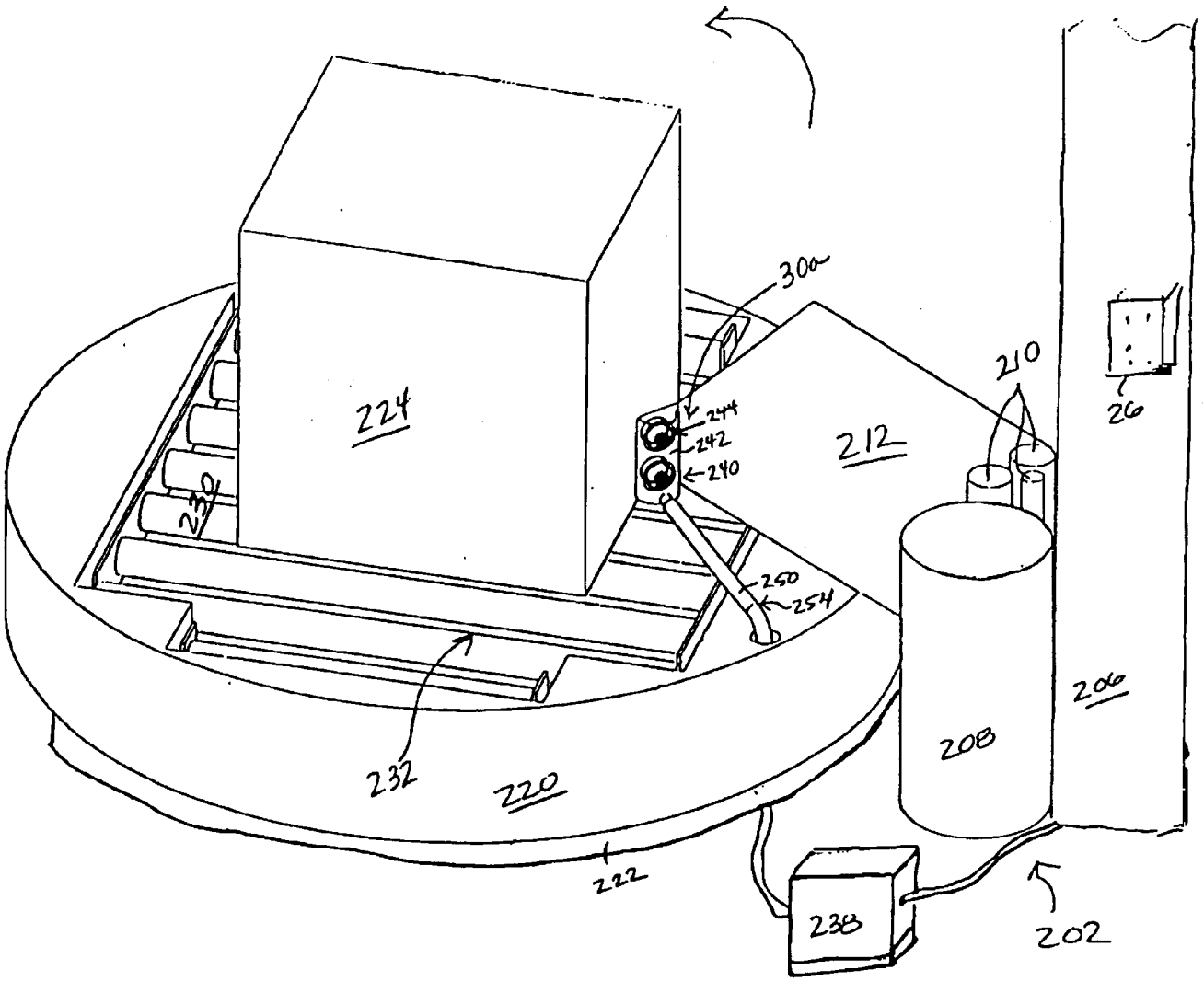
FIGS. 9–11 are perspective views of a stretch wrap packaging apparatus of the second embodiment of the present invention showing positioning of the packaging material holder at different points during the wrapping sequence.
Figure 10:
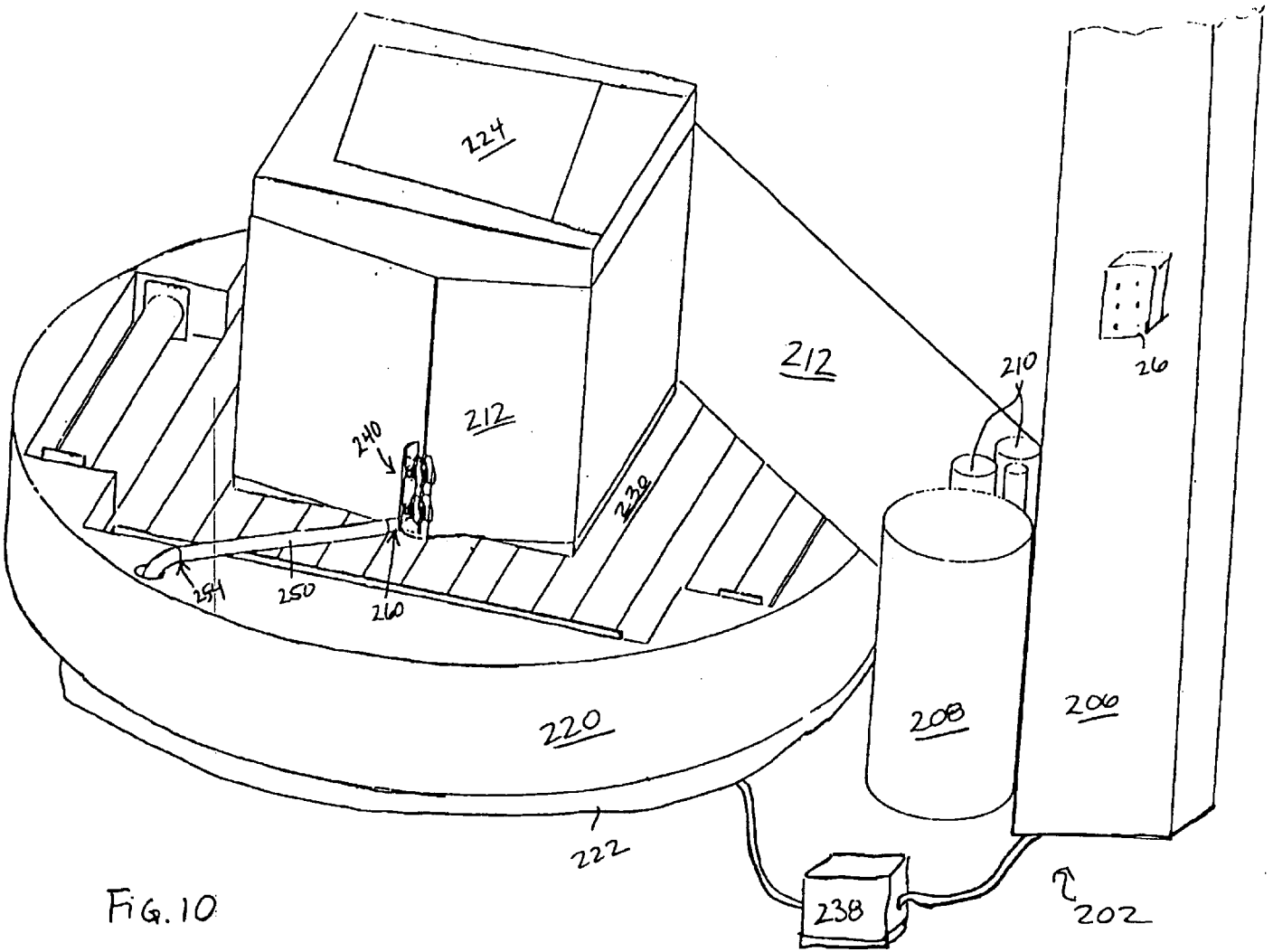
Figure 11:
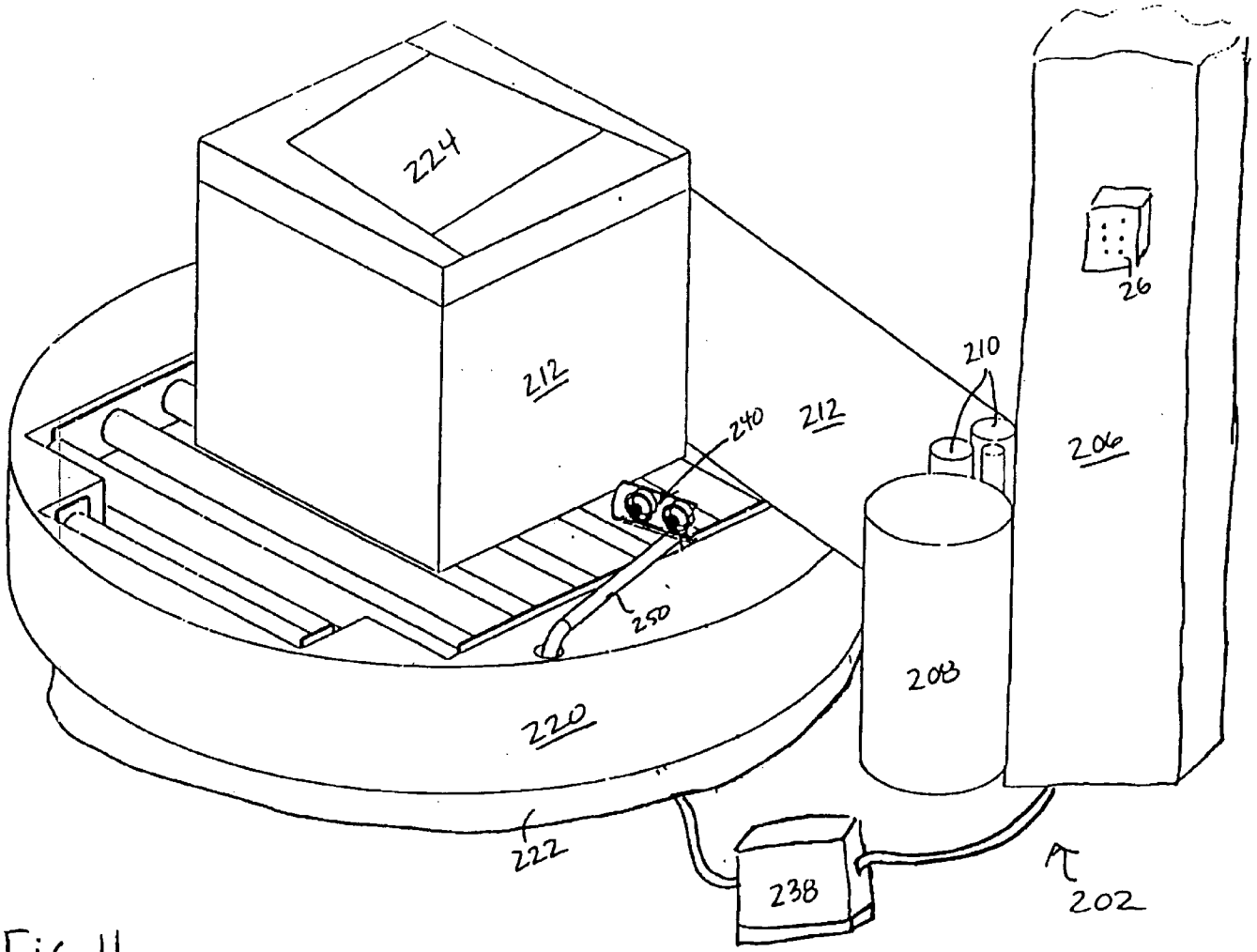
Figure 12B:
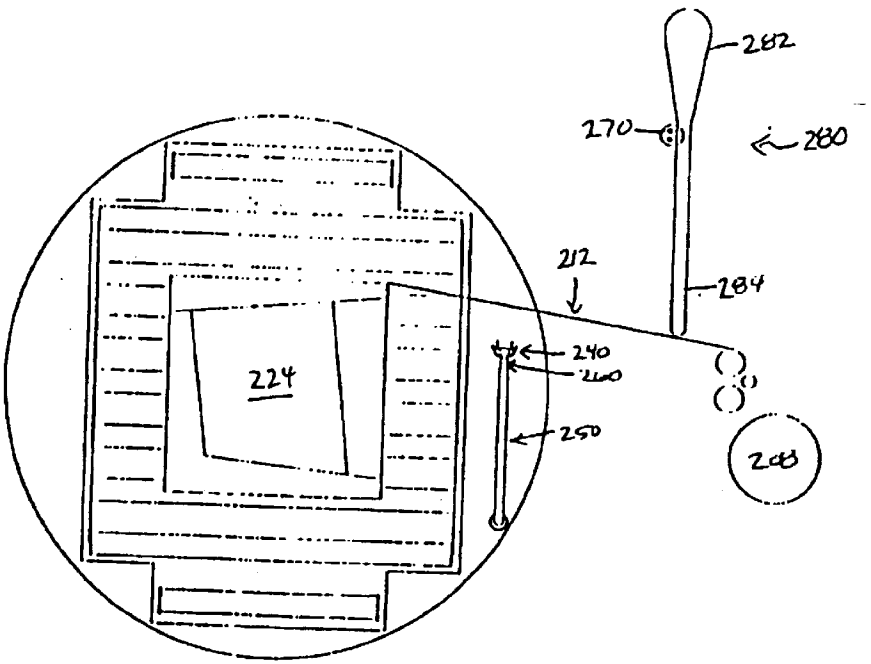
FIGS. 12A and 12B are a perspective view and a plan view, respectively, of the second embodiment of the stretch wrapping apparatus after the stretch wrap has be wrapped around the load.
Figure 12A:
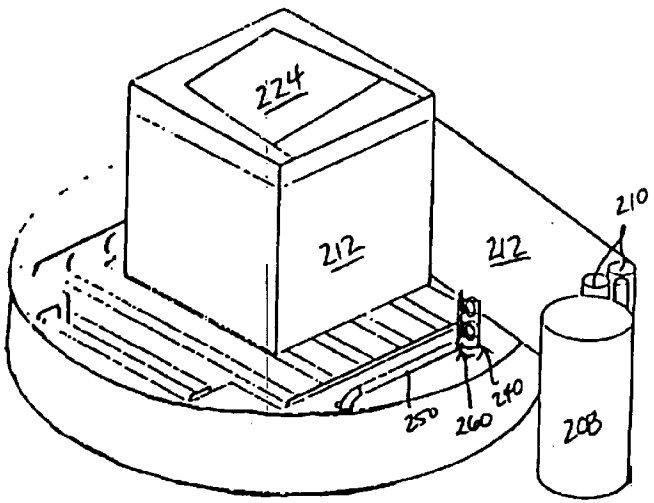
Figure 13B:
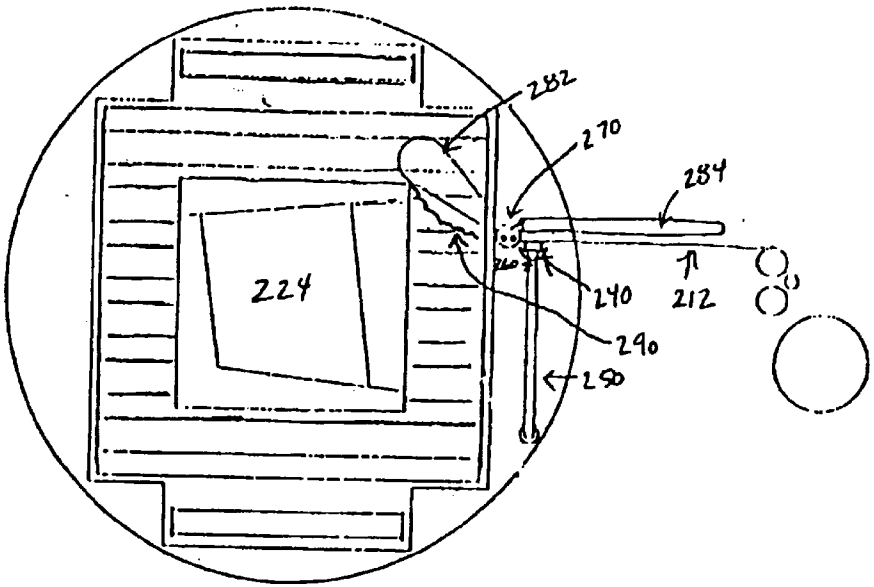
FIGS. 13A and 13B are a perspective view and a plan view, respectively, of the second embodiment of the stretch wrapping apparatus after the load has been wrapped and the stretch wrap cut.
Figure 13A:
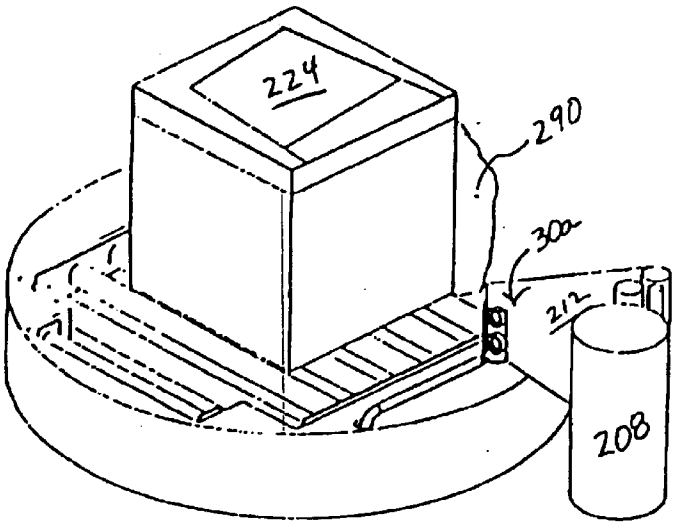
Figure 14B:
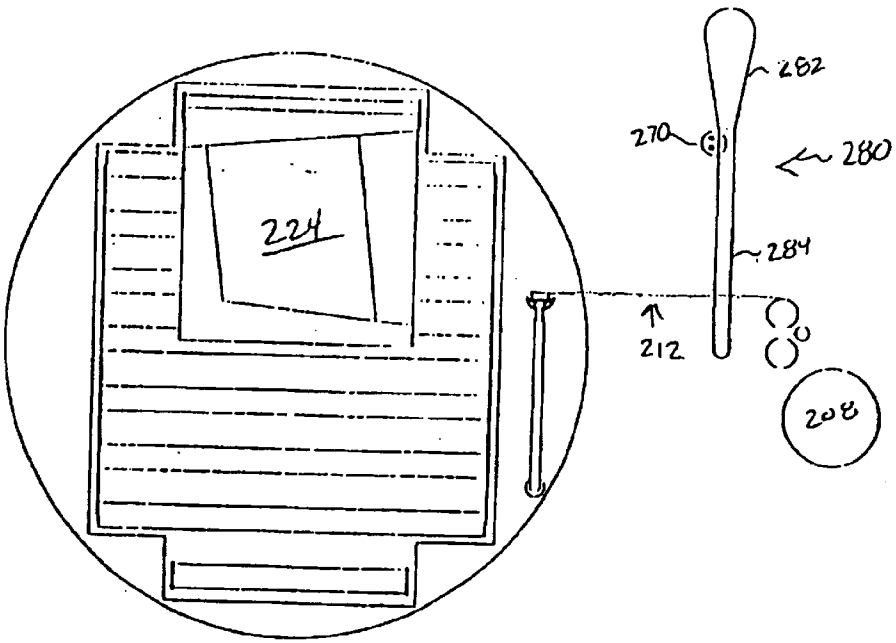
FIGS. 14A and 14B are a perspective view and a plan view, respectively, of the second embodiment of the stretch wrapping apparatus with the packaging material holder in the "home" position after the load has been wrapped and conveyed out of the wrapping area.
Figure 14A:
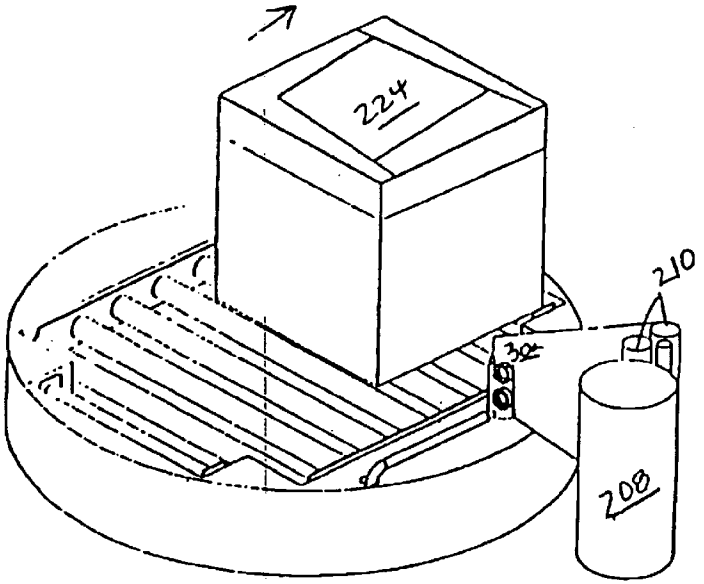

In the second embodiment of the present invention, as shown in FIGS. 8–14, a load is conveyed by a conveyor 218 to a turntable 220 having load support surface 230 in the wrapping station. A leading end portion 30*a* of a sheet of stretch wrap packaging material 212 is engaged by the vacuum cups 244 on unopposed surface 242 of the packaging material holder 240. Turntable 220 begins to rotate load 224 of load units 226 sitting on load support surface 230 about a vertical axis 228 relative to film dispenser 202. As turntable 220 rotates about axis 228, the force exerted upon packaging material holder 240 by leading end portion 30*a* of packaging material 212 causes packaging material 212 and packaging material holder 240 on supporting arm 250 on the turntable 220 to move above the load support surface 230 from a radially outward position distant from the sides of the load to a radially inward position near the sides of the load as shown in FIG. 9. In a preferred embodiment, the packaging material holder 240 will continue to move toward the sides of the load until it touches a side of the load, thus stopping the movement of the packaging material holder 240. The remainder of the wrapping process is the same as discussed in the first embodiment shown in FIGS. 1–7.

Alternatively, as discussed in the third embodiment of the present invention and as shown in FIGS. 16–20, support arm 350 and packaging material holder 340 are moved between the distant position and the near position not by the force applied by the leading end 30*b* of the packaging material 312, but are actuated by an air cylinder causing an extensible support arm portion 352 to extend from within support arm 350 toward the load with packaging material holder 340. Extensible support arm portion 352 and packaging material holder 340 move linearly above the load support surface 330 towards the load 324 until packaging material holder 340 touches a side of the load and the wrapping begins.

Figure 18:
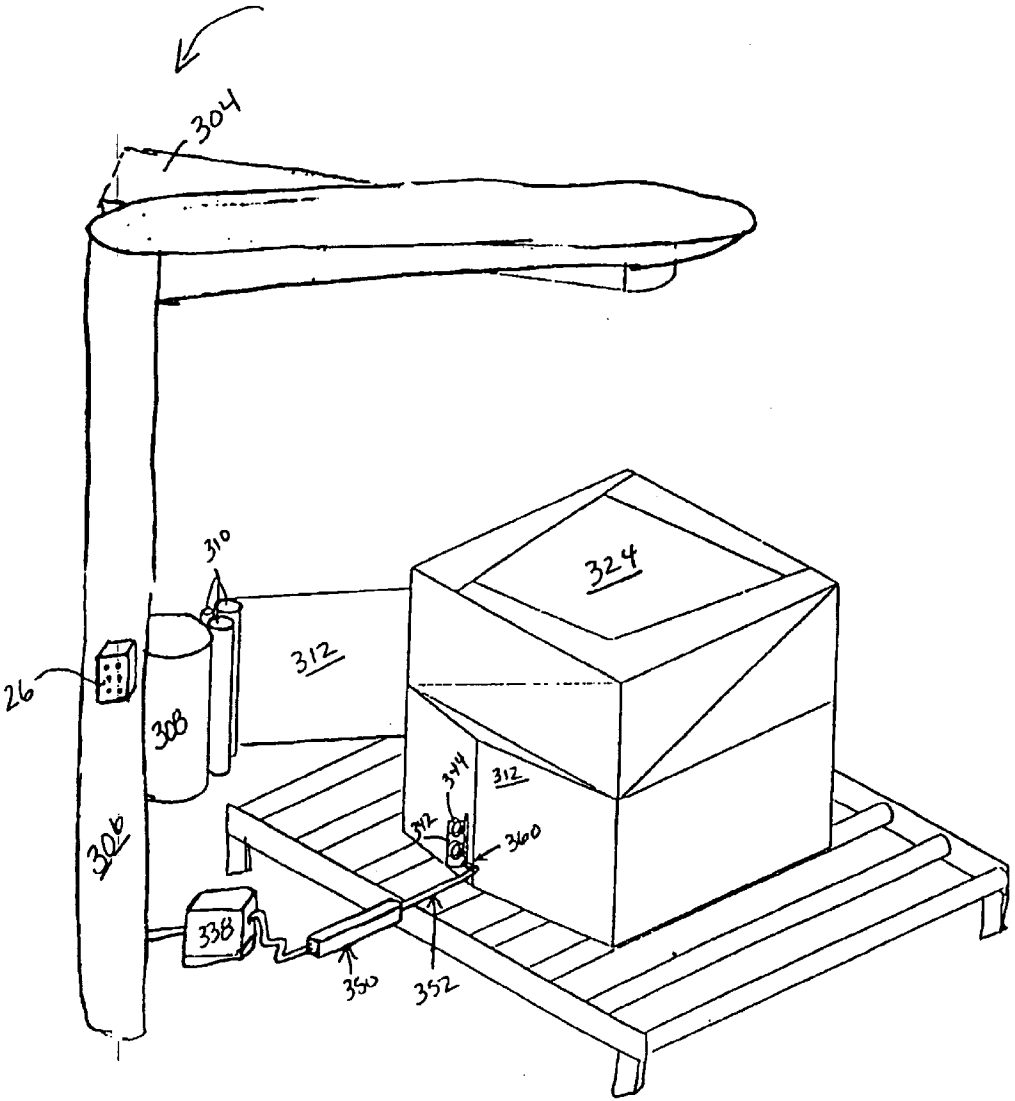
Figure 19:
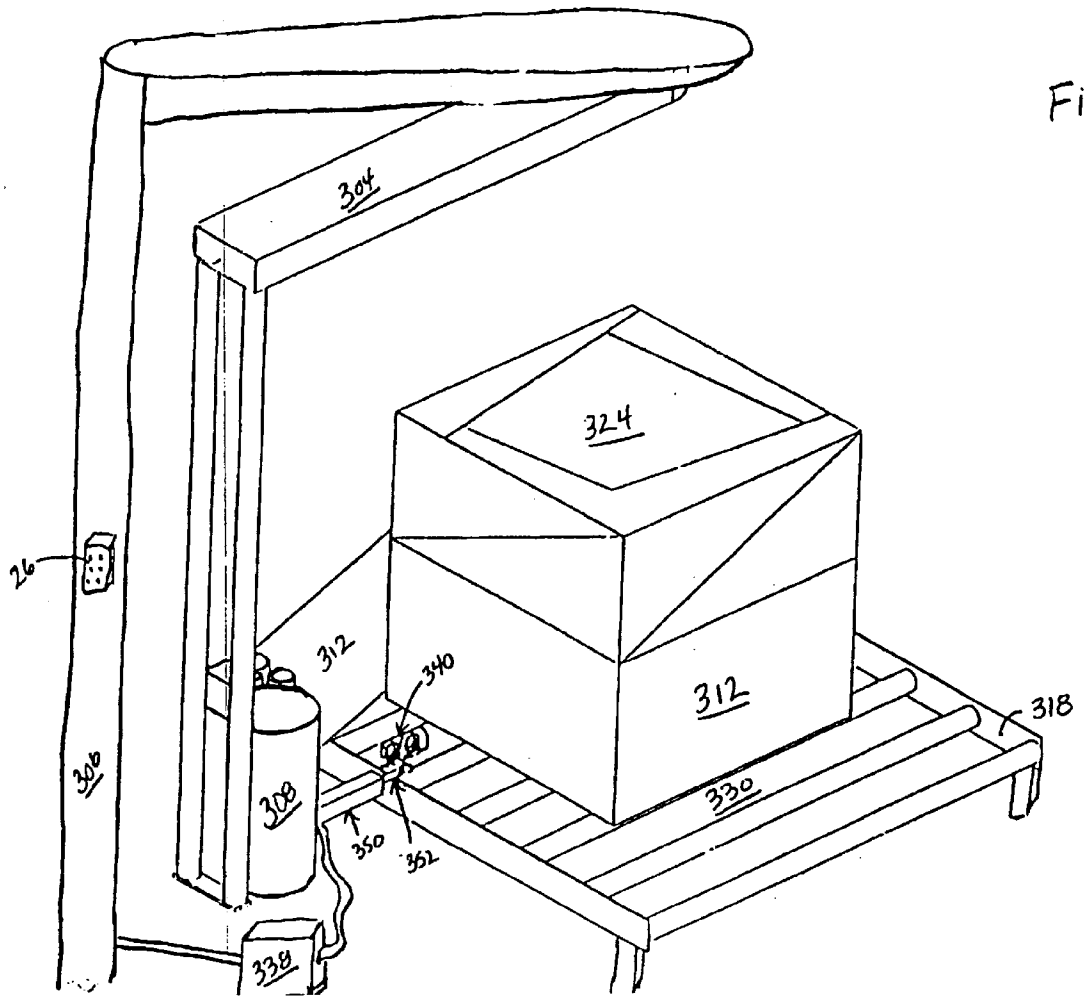
Figure 20:
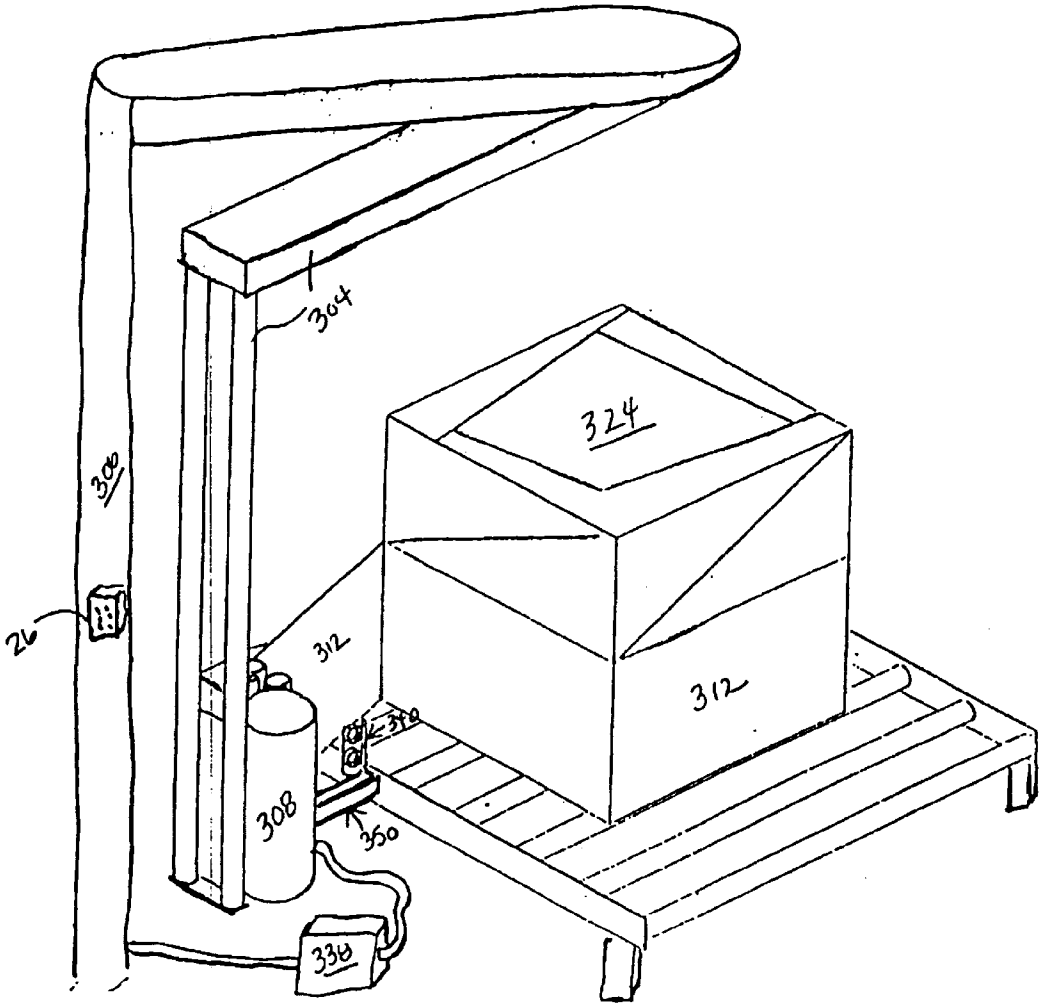

After load 324 is wrapped and arm 304 and dispenser 302 have returned to a "home" position, overwrapped packaging material holder 340 releases the leading end 30*b* of packaging material and rotates relative to load 324 to move from between packaging material 312 and load 324 as shown in FIGS. 18 and 19. If packaging material holder 340 is employing a vacuum surface 342, controller 26 stops the vacuum and supplies a positive flow of air to blow packaging material 312 away from vacuum surface 342 and vacuum cups 344.

As shown in the embodiment in FIGS. 18 and 19, packaging material holder 340 rotates on a flexible wrist portion 360 relative to extensible support arm portion 352 and support arm 350, and by this rotation moves out from between the load 324 and packaging material 312. If the flexible wrist portion includes a spring, movement of extensible support arm portion 352 away from the wrapped load toward the distant position will generate a force sufficient to cause packaging material holder 340 to rotate relative to the load 324, extensible support arm portion 352, and support arm 350 to move packaging material holder 340 from between load 324 and packaging material 312.

Alternatively, if packaging material holder 340 is rigidly connected to extensible support arm portion 352, both packaging material holder 340 and extensible support arm portion 352 may rotate together along the principal axis of extensible support arm portion 352 to move packaging material holder 340 out from between the load 324 and packaging material 312. In an alternative embodiment, where packaging material holder 340 is rigidly connected to extensible support arm portion 352 and support arm 350, packaging material holder 340, extensible support arm portion 352, and support arm 350 may rotate together relative to the side of the load about an axis generally perpendicular to the principal axis of support arm 350 to slide packaging material holder 340 out from between the load 324 and packaging material 312 in a "shoehorn" type of motion.

After packaging material holder 340 moves from between load 324 and packaging material 312, extensible support arm portion 352 and packaging material holder 340 move away from the load to the distant position. The remainder of the wrapping process is the same as discussed for the embodiment depicted in FIGS. 1–7.

As depicted in the fourth embodiment, to begin the wrapping process, support arm 450 mounted on a vertically moveable frame 425 and supporting wrapping ring 415 and packaging material dispenser 402 is in a radially outward position distant from the load. Packaging material holder 440 engages a leading end 30*c* of packaging material 412, and as wrapping ring 415 and dispenser 402 begin to rotate about load 424, support arm 450 and packaging material holder 440 are pulled toward the side of load 424 by the force exerted on the leading end 30*c* of packaging material 412 by the rotation of the dispenser 402. Due to the rotational force, support arm 450 and packaging material holder 440 move above the load support surface from a distant position toward the side of the load until the near position is reached. The remainder of the wrapping process is essentially as discussed above with reference to FIGS. 1–7.

The present invention as embodied herein and described above, allows fully automated wrapping of loads at a drastically reduced cost and in an extremely efficient manner. The simplicity of the apparatus and its function allows any existing rotary stretch wrapping apparatus to be retro-fit to become fully automated. The present invention also overcomes the problems in the prior art, in particular, costly mechanical devices that require upkeep and repair, mechanical interference in load support and conveying means, and leaving a tail portion of the packaging material hanging free from the load.

It will be apparent to those skilled in the art that various modifications and variations can be made in the present invention without departing from the spirit or scope of the invention. Thus, it is intended that the present invention cover all modifications and variations of this invention that come within the scope of the appended claims and their equivalents.

What is claimed is:

1. An apparatus for retaining and positioning a free end of packaging material to a load to be wrapped with a rotary stretch wrapping apparatus, comprising:

an unopposed packaging material holder moveable between a first position and a second position;

a support arm for moving the packaging material holder between a position distant from the sides of the load to be wrapped and a position near the sides of the load to be wrapped; and a support frame for the support arm and configured to be mounted on or adjacent to a load support surface of a rotary stretch wrapping apparatus wherein the packaging material holder is flexibly connected to the support arm.

2. An apparatus for retaining and positioning a free end of packaging material to a load to be wrapped with a rotary stretch wrapping apparatus, comprising:

an unopposed packaging material holder moveable between a first position and a second position;

a support arm for moving the packaging material holder between a position distant from the sides of the load to be wrapped and a position near the sides of the load to be wrapped; and a support frame for the support arm and configured to be mounted on or adjacent to a load support surface of a rotary stretch wrapping apparatus, wherein the packaging material holder is rotatable about a wrist portion relative to the support arm.

* * * * *